US008171576B2

(12) United States Patent
Kitaura et al.

(10) Patent No.: US 8,171,576 B2
(45) Date of Patent: May 8, 2012

(54) JETTED BATHTUB

(75) Inventors: Hidekazu Kitaura, Kitakyusyu (JP); Katsushi Uryu, Kitakyusyu (JP); Hirotomo Suyama, Kitakyusyu (JP); Hidetaka Miyahara, Kitakyusyu (JP); Makoto Hatakeyama, Kitakyusyu (JP)

(73) Assignee: Toto Ltd., Fukuoka (JP)

( * ) Notice: Subject to any disclaimer, the term of this patent is extended or adjusted under 35 U.S.C. 154(b) by 1086 days.

(21) Appl. No.: 12/077,528

(22) Filed: Mar. 18, 2008

(65) Prior Publication Data

US 2008/0235863 A1 Oct. 2, 2008

(30) Foreign Application Priority Data

Mar. 20, 2007 (JP) ..... 2007-073535

(51) Int. Cl.
*A47K 3/10* (2006.01)
*A61H 33/00* (2006.01)

(52) U.S. Cl. ..... 4/541.6; 4/592; 4/541.2; 4/541.3; 4/541.1

(58) Field of Classification Search ..... 4/541.1, 4/541.2, 541.4, 541.5, 541.6, 592, 541.3
See application file for complete search history.

(56) References Cited

U.S. PATENT DOCUMENTS

| | | | | |
|---|---|---|---|---|
| 3,297,025 | A * | 1/1967 | Jacuzzi | 601/157 |
| 3,571,820 | A * | 3/1971 | Jacuzzi | 4/541.4 |
| 3,890,656 | A * | 6/1975 | Mathis | 4/541.4 |
| 4,320,541 | A | 3/1982 | Neenan | |
| 4,918,768 | A * | 4/1990 | DeSousa et al. | 4/541.5 |
| 5,010,605 | A * | 4/1991 | Shiina et al. | 4/541.2 |
| 5,014,372 | A | 5/1991 | Thrasher et al. | |
| 5,125,582 | A | 6/1992 | Surjaatmadja et al. | |
| 5,956,784 | A * | 9/1999 | Perdreau et al. | 4/541.1 |
| 5,983,417 | A * | 11/1999 | Perdreau et al. | 4/541.6 |
| 6,860,437 | B1 * | 3/2005 | Amendt et al. | 239/383 |
| 2007/0124856 | A1 | 6/2007 | Santamarina et al. | |

FOREIGN PATENT DOCUMENTS

| | | |
|---|---|---|
| DE | 4409656 | 3/1995 |
| JP | 1-214365 A | 8/1989 |
| JP | 2-128765 | 5/1990 |
| JP | 4-061859 | 2/1992 |
| JP | 4-176461 | 6/1992 |
| JP | 2001-8998 | 11/2000 |
| JP | 2004-000513 A | 1/2004 |
| JP | 2005-245987 A | 9/2005 |

* cited by examiner

*Primary Examiner* — Jeanette E. Chapman
(74) *Attorney, Agent, or Firm* — Carrier Blackman & Associates, P.C.; Joseph P. Carrier; William D. Blackman

(57) ABSTRACT

A jetted bathtub includes: a bathtub; a suction port opening in a wall of the bathtub and allowing water stored in the bathtub to be sucked therein; a pressurizer configured to suck water from the suction port, and pressurize and discharge the water; and a jet nozzle having a single tube held on the wall below a rim of the bathtub, the jet nozzle being configured to eject water introduced into the tube so that the water is ejected into the bathtub with its ejection direction being varied. The tube includes: a running water introduction section configured to receive water supplied from the pressurizer; a channel cross-section shrinking section communicating with the running water introduction section on the downstream side of the running water introduction section, and having a reduced channel cross section relative to the running water introduction section; and a chamber communicating with the channel cross-section shrinking section on the downstream side of the channel cross-section shrinking section, and having at its upstream end a channel cross-section abrupt expansion section with a channel cross section abruptly expanded relative to the channel cross-section shrinking section and at its downstream end an ejection port facing the inside of the bathtub.

8 Claims, 25 Drawing Sheets

(L=76.6[mm], D=27.3[mm], d=8.3[mm], Q=40[L/min])

(L=76.6[mm], D=27.3[mm], d=8.3[mm], Q=40[L/min])

JETTED BATHTUB

CROSS-REFERENCE TO RELATED APPLICATIONS

This application is based upon and claims the benefit of priority from the prior Japanese Patent Application No. 2007-073535, filed on Mar. 20, 2007; the entire contents of which are incorporated herein by reference.

BACKGROUND OF THE INVENTION

1. Field of the Invention

This invention relates to a jetted bathtub having a jet nozzle for ejecting a jet flow into a bathtub, and more particularly to a jetted bathtub in which a jet flow swirling about the nozzle central axis is ejected.

2. Background Art

It is conventionally known that a jet flow is ejected into a bathtub from a jet nozzle disposed on a wall. In most of such techniques, the jet flow is ejected straight and locally hits a portion of the bather's body. Thus, the stimulus provided by the jet flow is monotonous and boring, and it is difficult to achieve diversity in massage feeling.

JP-A 2001-8998(Kokai) discloses a nozzle apparatus comprising a nozzle body having a generally circular outer shape and rotatably housed in a unit jet port cover, and an orifice for squirting water in a bathtub into the jet hole of the nozzle body at a prescribed pressure. The jet port of the jet hole disposed inside the nozzle body is decentered from the shaft position. The water in the bathtub is squirted through the orifice into the jet hole of the nozzle body at a prescribed pressure and mixed with air to form a bubble-mixed jet flow, which is squirted from the jet port of the jet hole into the bathtub. At this time, the nozzle body is rotated by the jet flow from the orifice, because the jet port of the nozzle body is disposed at a position decentered with respect to the shaft position. This results in a rotary jet flow with changing squirt direction of the jet flow.

However, in JP-A 2001-8998(Kokai), the configuration for rotating the nozzle body to produce a rotary jet flow complicates the structure for rotatably supporting the nozzle body, thus interfering with cost-effective fabrication. Furthermore, there is concern about the decrease of rotation performance due to wear and clogging in the rotary sliding portion.

Moreover, the configuration disclosed in JP-A 2001-8998 (Kokai) has a doubly nested structure in which a cylindrical nozzle body is rotatably provided in a cylindrical attachment member attached to the wall. This complicates the structure, and includes a narrow gap between the nozzle body corresponding to an inner tube and the attachment member corresponding to an outer tube. Thus, there is also concern about clogging of the gap with dust.

An apparatus disclosed in JP-A 2-128765(Kokai) includes a narrow gap between a structure (corresponding to an inner tube), the inner surface of which serves as a guiding wall having a channel width gradually expanding toward the downstream side, and the inner wall surface of a structure (corresponding to an outer tube) attached to a wall. The gap serves as a channel for allowing part of the water flowing downstream to flow back to the upstream side. Thus, the apparatus disclosed in JP-A 2-128765(Kokai) also has a double structure. Hence the structure is complicated, and there is concern about clogging of the narrow channel (gap).

A nozzle disclosed in JP-A 4-61859(Kokai) also has a double structure. Likewise, the structure is complicated, and there is concern about clogging of the narrow channel (gap).

In an apparatus disclosed in JP-A 4-1764-61(Kokai), the jet flow undergoes reciprocating motion. Hence the stimulus to the bather's body follows a linear trajectory, which is insufficient to serve as a stimulated area. Furthermore, the jet nozzle disclosed in JP-A 4-176461(Kokai) is intended to eject water into the air, and cannot provide stimuli to some portions of the bather's body located in water in the normal bathing posture such as the hip, back, flanks, arms, calves, and soles.

SUMMARY OF THE INVENTION

According to an aspect of the invention, there is provided a jetted bathtub including: a bathtub; a suction port opening in a wall of the bathtub and allowing water stored in the bathtub to be sucked therein; a pressurizer configured to suck water from the suction port, and pressurize and discharge the water; and a jet nozzle having a single tube held on the wall below a rim of the bathtub, the jet nozzle being configured to eject water introduced into the tube so that the water is ejected into the bathtub with its ejection direction being varied, the tube including: a running water introduction section configured to receive water supplied from the pressurizer; a channel cross-section shrinking section communicating with the running water introduction section on the downstream side of the running water introduction section, and having a reduced channel cross section relative to the running water introduction section; and a chamber communicating with the channel cross-section shrinking section on the downstream side of the channel cross-section shrinking section, and having at its upstream end a channel cross-section abrupt expansion section with a channel cross section abruptly expanded relative to the channel cross-section shrinking section and at its downstream end an ejection port facing the inside of the bathtub.

DETAILED DESCRIPTION OF THE INVENTION

An embodiment of the invention will now be described with reference to the drawings.

Figure 2:
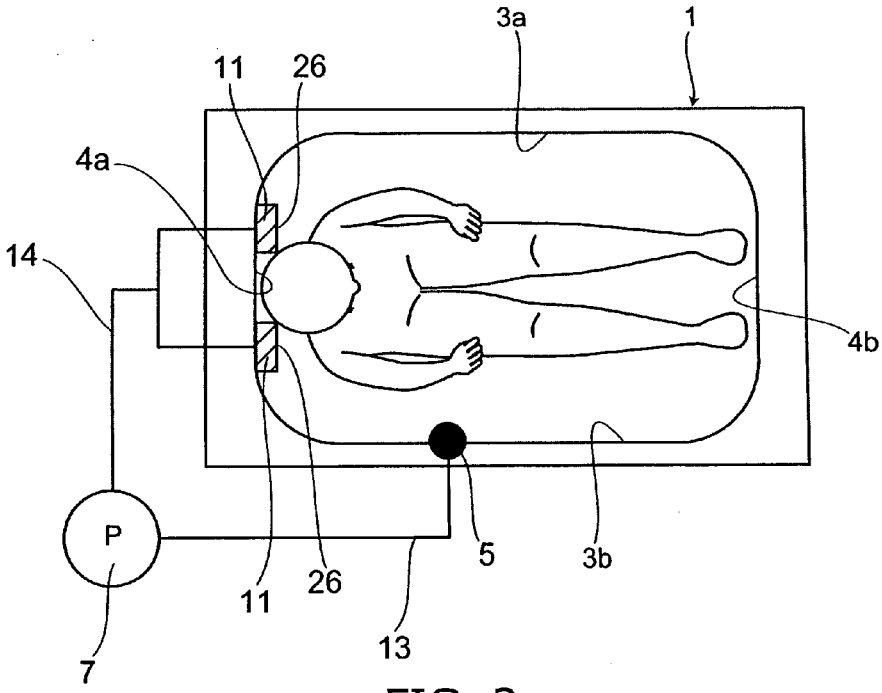
FIG. 2 is a schematic view showing the schematic configuration of a jetted bathtub according to the embodiment of the invention.

FIG. 2 is a schematic view showing the schematic configuration of a jetted bathtub according to the embodiment of the invention.

Figure 3:
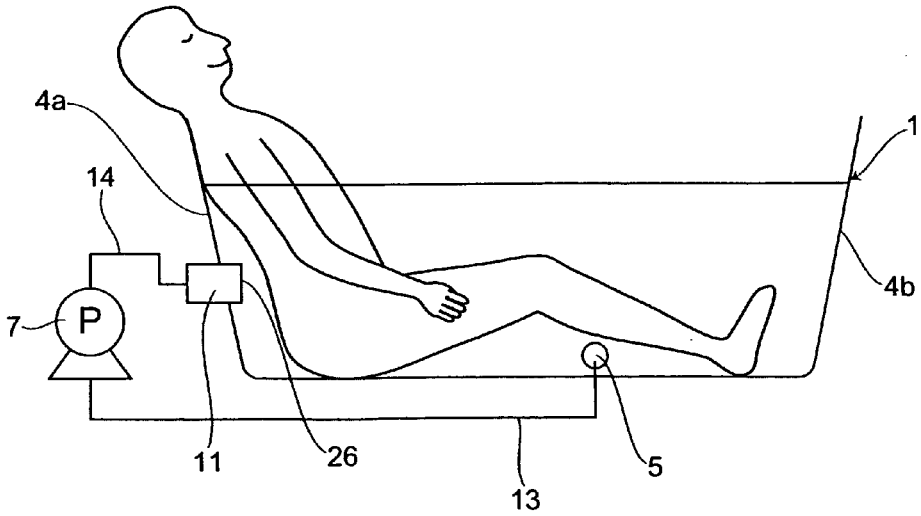
FIG. 3 is a schematic view of the bathtub of the jetted bathtub as viewed from a side.

FIG. 3 is a schematic view of the bathtub of the jetted bathtub as viewed from a side.

As shown in FIG. 2, the jetted bathtub according to this embodiment comprises a bathtub 1, a suction port 5 opening in a wall 3*b* of the bathtub 1, a circulation path 13, 14, a pump 7 serving as a pressurizer disposed halfway along the circulation path 13, 14, and a jet nozzle 11 held on a wall 4*a*.

The bathtub 1 has a pair of long sidewalls 3*a*, 3*b* opposed generally in parallel to each other, and a pair of short sidewalls 4*a*, 4*b* opposed generally in parallel to each other The suction port 5 is formed in the long sidewall 3*b*. When the pump 7 is operated, water stored in the bathtub 1 is sucked through the suction port 5 to the circulation path 13.

Typically, during bathing, the bather takes a posture in which the back is leaned on the first short sidewall (the short sidewall 4*a* in the example shown in FIG. 2) and the legs are directed to the second short sidewall (the short sidewall 4*b* in the example shown in FIG. 2). Thus, if the suction port 5 is formed in the short sidewall, there is concern that the bather's back or sole occludes the suction port 5 to impose an extra load on the pump 7. Hence the suction port 5 is preferably formed in the long sidewall, which is unlikely to be occluded by a portion of the bather's body. While the suction port 5 is formed in the long sidewall 3*b* in the example shown in FIG. 2, it can alternatively be formed in the long sidewall 3*a*.

One end of the circulation path 13 is connected to the suction port 5, and the other end is connected to the suction port of the pump 7. One end of the circulation path 14 is connected to the discharge port of the pump 7, and the other end is connected to the running water introduction port of the jet nozzle 11. The pump 7 sucks water from the suction port 5 into the circulation path 13, pressurizes the sucked water, and discharges it to the circulation path 14 downstream of the pump 7. The pressurized water discharged from the pump 7 flows into the running water introduction port of the jet nozzle 11. To drain residual water inside the pump 7 when not in use, the pump 7 is preferably disposed above the suction port 5.

In this example, as shown in FIG. 2, two jet nozzles 11 are attached to the first short sidewall 4*a* of the bathtub. The two jet nozzles 11 are disposed at a generally equal height (in this embodiment, approximately 230 mm from the bottom of the bathtub 1), spaced by a prescribed distance (in this embodiment, the distance between the two jet nozzles 11 is approximately 160 mm, and the midpoint between the installation positions of the two jet nozzles 11 coincides with the center along the short sidewall 4*a*). A bathtub faucet is disposed above the second short sidewall 4*b* on the opposite side of the first short sidewall 4*a* to which the jet nozzle 11 is attached. Hence, typically, during bathing, the bather automatically takes a posture in which the back faces the short sidewall 4*a* provided with the jet nozzle 11.

Figure 1A:
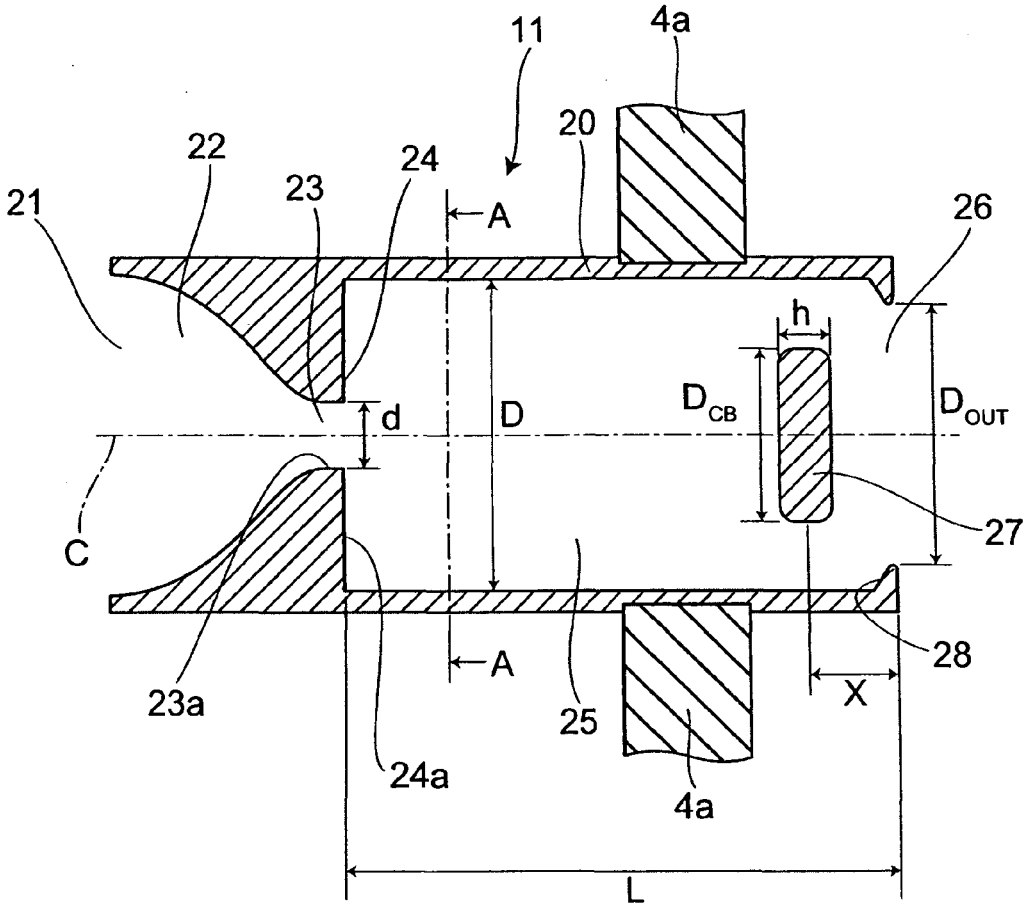
FIG. 1A is a schematic cross-sectional view of the jet nozzle in an embodiment of the invention.
Figure 1B:
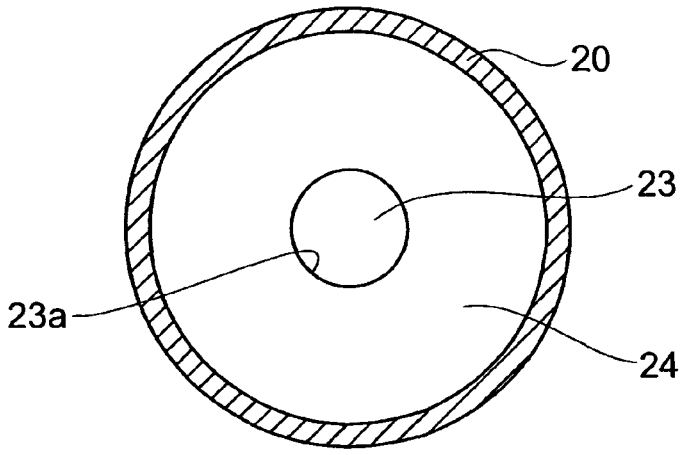
FIG. 1B is an A-A cross-sectional view of FIG. 1A.

FIG. 1A is a schematic cross-sectional view of the jet nozzle 11 in the embodiment of the invention, and FIG. 1B is the A-A cross-sectional view of FIG. 1A.

The jet nozzle 11 has, at one end (upstream end), a running water introduction port 21 to be in communication with the circulation path 14, and at the other end (downstream end), a generally cylindrical tube 20 provided with an ejection port 26.

The tube 20 is held on the first short sidewall 4*a* with the ejection port 26 facing the inside of the bathtub 1. The tube 20 is held on the wall 4*a* below the rim of the bathtub 1. The term "rim" used herein refers to the rim of the portion of the bathtub 1 where water poured into the bathtub 1 first overflows therefrom. This configuration allows the jet flow from the jet nozzle 11 to be ejected under the water.

The ejection port 26 of the jet nozzle 11 is directed to the second short sidewall 4*b*. The running water introduction port 21 is connected to the circulation path 14 outside the bathtub 1.

Inside the tube 20 between the running water introduction port 21 and the ejection port 26, a running water introduction section 22, a channel cross-section shrinking section 23, and a chamber 25 are provided in this order from the upstream side (running water introduction port 21 side). Through them, the running water introduction port 21 is in communication with the ejection port 26.

The running water introduction section 22 is provided between the running water introduction port 21 and the channel cross-section shrinking section 23, and has a channel cross section gradually narrowed from the running water introduction port 21 toward the channel cross-section shrinking section 23. The channel cross-section shrinking section 23 is located at the axial center of the tube 20, and has a reduced channel cross section relative to the running water introduction port 21 and the running water introduction section 22.

On the downstream side of the channel cross-section shrinking section 23 is provided a chamber 25 having a channel cross-section abrupt expansion section 24 at one end (upstream end) where the channel cross section is abruptly expanded (for example, the diameter is abruptly expanded by a factor of three or more) relative to the channel cross-section shrinking section 23. The chamber 25 extends to the vicinity of the ejection port 26 with the inner diameter dimension remaining equal to that of the channel cross-section abrupt expansion section 24. That is, the upstream end of the chamber 25 serves as the channel cross-section abrupt expansion section 24, and the downstream end of the chamber 25 serves as the ejection port 26.

The wall surface 23*a*, 24*a* surrounding the space inside the tube 20 from the channel cross-section shrinking section 23 to the channel cross-section abrupt expansion section 24 changes in a generally perpendicular fashion. More specifically, the wall surface 23*a* around the channel cross-section shrinking section 23 is generally parallel to the axial direction of the tube 20, whereas the wall surface 24*a* at the upstream end of the chamber 25, serving as the channel cross-section abrupt expansion section 24, continues from the wall surface 23*a* in a generally perpendicular fashion and expands in a radially outward direction. This abrupt change of the channel wall surface causes flow separation from the wall surface at the channel cross-section abrupt expansion section 24 as described later.

It is noted that the wall surface 24*a* is not limited to expanding generally perpendicular to the wall surface 23*a*, but can be formed in a funnel (or trumpet) shape with the channel cross section expanding toward the downstream side so as to cause flow separation at the channel cross-section abrupt expansion section 24. However, the configuration of the wall surface 24*a* continuing from the wall surface 23*a* in a generally perpendicular fashion is more likely to facilitate flow separation at the channel cross-section abrupt expansion section 24.

Figure 26:
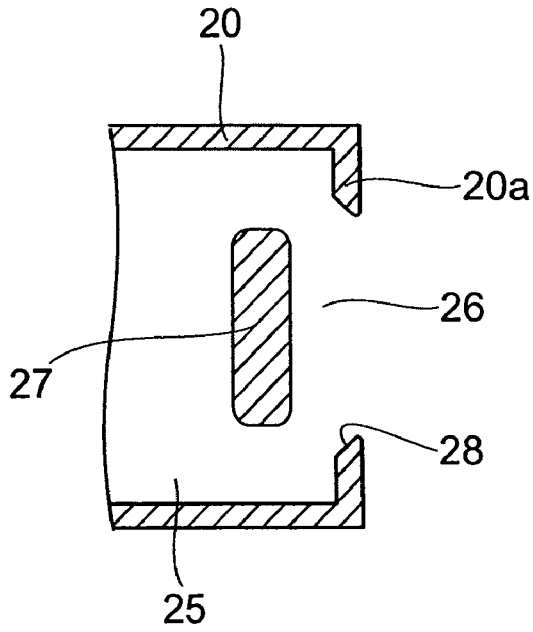
FIG. 26 is a schematic view showing another example of the structure at the downstream end of the chamber in the jet nozzle according to this embodiment of the invention.

The inner wall surface of the chamber 25 extends generally parallel to the axial center C of the tube 20 from the channel cross-section abrupt expansion section 24 to the vicinity of the ejection port 26. The inner wall surface continuing to the ejection port 26 downstream of the chamber 25 is formed into an annular beveled surface 28 beveled toward the axial center C of the tube 20. Alternatively, as shown in FIG. 26, a lip 20*a* continuing at a generally right angle to the inner peripheral surface of the chamber 25 can be provided at the downstream end of the tube 20, and a beveled surface 28 can be provided at the inner peripheral edge of the lip 20*a*. This structure can also achieve the same effect as the beveled surface 28 of the structure shown in FIG. 1.

An interceptor 27 partly intercepting the channel in the chamber 25 led to the ejection port 26 is disposed near the ejection port 26 in the chamber 25.

Figure 4A:
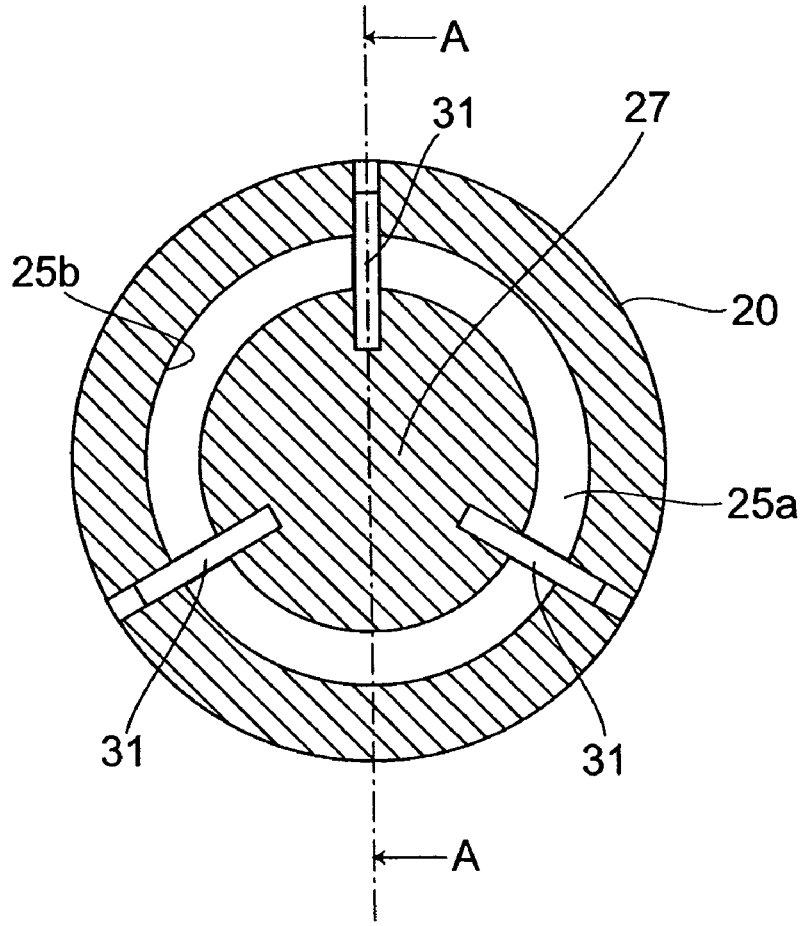
FIG. 4A is a cross-sectional view of the relevant part of the jet nozzle according to this embodiment.
Figure 4B:
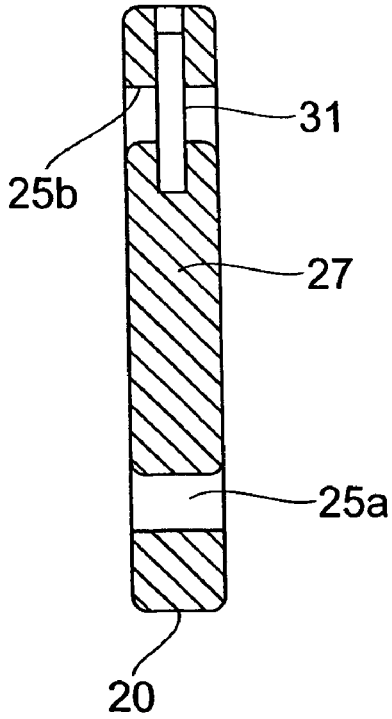
FIG. 4B is an A-A cross-sectional view of FIG. 4A.

FIG. 4A is a cross-sectional view of the tube 20 and the chamber 25 at the position where the interceptor 27 is disposed, and FIG. 4B is the A-A cross-sectional view of FIG. 4A.

The interceptor 27 is shaped like a disk and disposed inside the chamber 25 with its center aligned with the axial center C of the tube 20. The interceptor 27 does not entirely intercept the channel in the chamber 25, but leaves a channel 25 between the interceptor 27 and the inner wall 25*b* of the chamber 25, allowing water to flow from the chamber 25 to the ejection port 26.

The interceptor 27 is supported on the inner wall 25*b* of the chamber 25 through three rod-like supports 31 radially disposed between the interceptor 27 and the inner wall 25*b* of the chamber 25. One end of the support 31 is fit into and fixed to the interceptor 27, and the other end is fit into and fixed to a hole formed in the inner wall 25*b* of the chamber 25. The three supports 31 are equally spaced along the circumferential direction around the outer peripheral surface of the interceptor 27.

The interceptor 27 receives the pressure of the pressurized water introduced from the running water introduction port 21 and flowing through the chamber 25 to the ejection port 26. Hence, use of only one support 31 cannot provide strength sufficient to withstand the above pressure, and the interceptor 27 may be detached. Use of only two supports 31 produces a moment about the supports due to the nonaxisymmetric distribution of the above pressure acting on the surface of the interceptor 27 with respect to the axial center C, and the moment may rotate the interceptor 27. Hence, preferably, three or more supports 31 are provided.

Figure 5A:
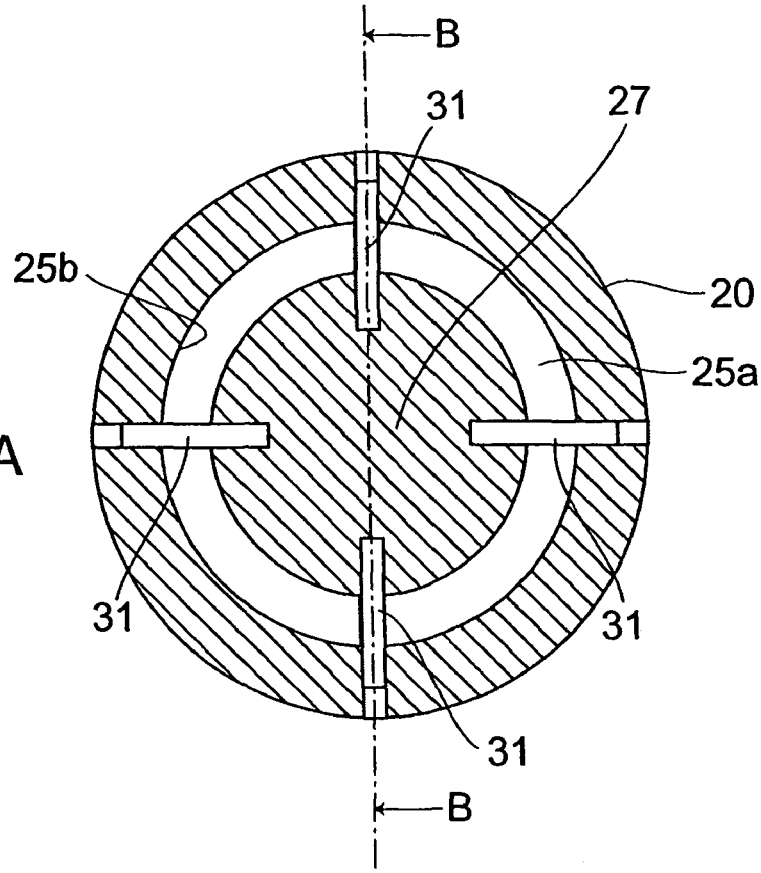
FIG. 5A is a cross-sectional view of the relevant part of the jet nozzle of another example.
Figure 5B:
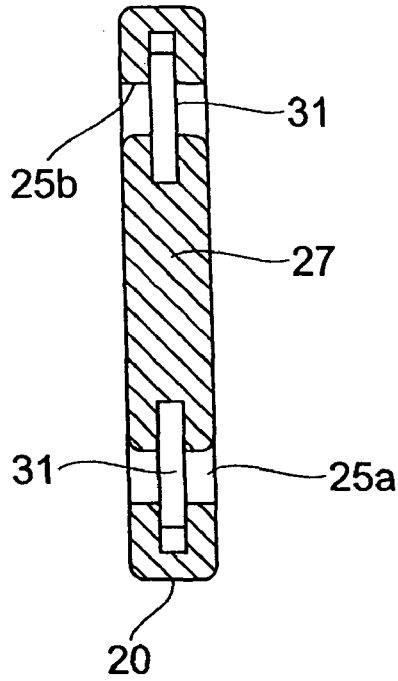
FIG. 5B is a B-B cross-sectional view of FIG. 5A.

For example, as shown in FIG. 5A and FIG. 5B, which is the B-B cross-sectional view thereof, four supports 31 can be disposed at spacings of 90° along the circumferential direction around the outer peripheral surface of the interceptor 27.

Figure 6A:
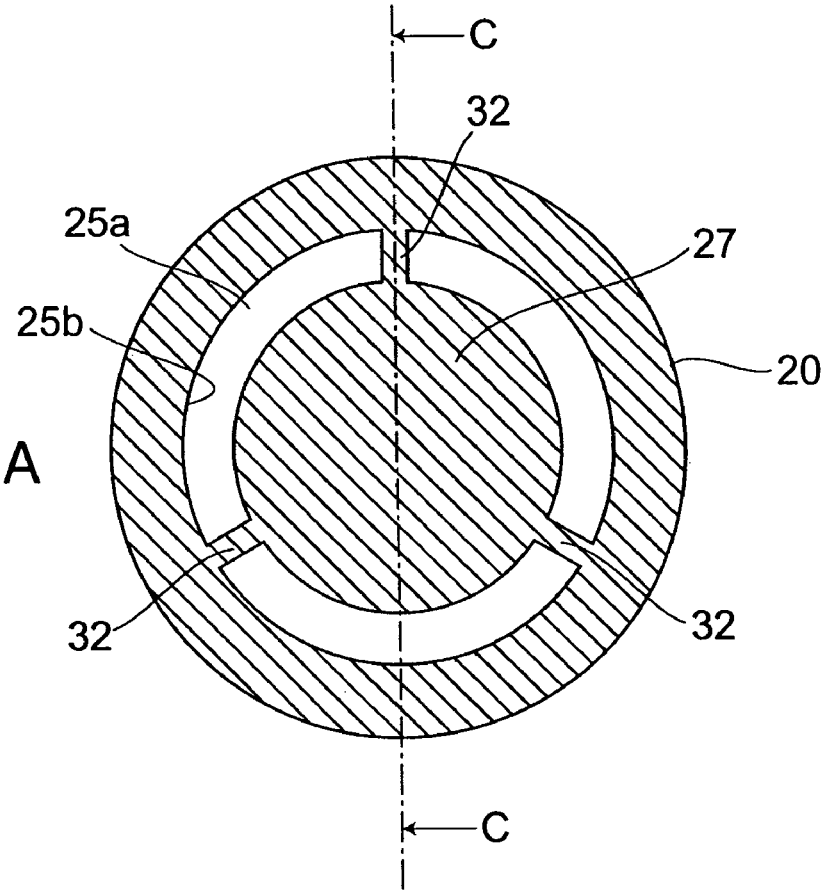
FIG. 6A is a cross-sectional view of the relevant part of the jet nozzle of still another example.
Figure 6B:
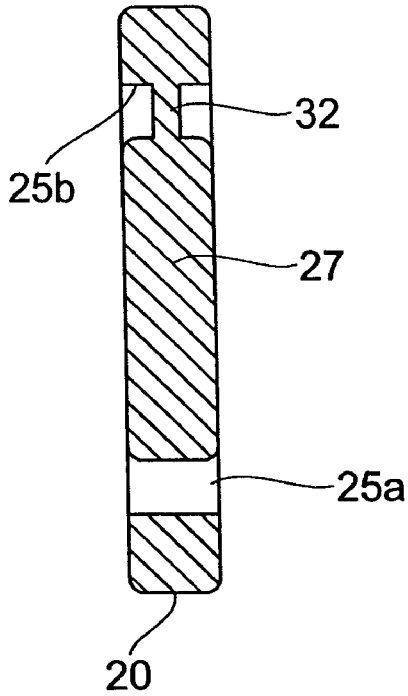
FIG. 6B is a C-C cross-sectional view of FIG. 6A.

Alternatively, as shown in FIG. 6A and FIG. 6B, which is the C-C cross-sectional view thereof, supports 32 can be integrated with the interceptor 27 and the inner wall 25*b* of the chamber 25. Then the number of parts can be decreased, allowing cost-effective fabrication.

Figure 7A:
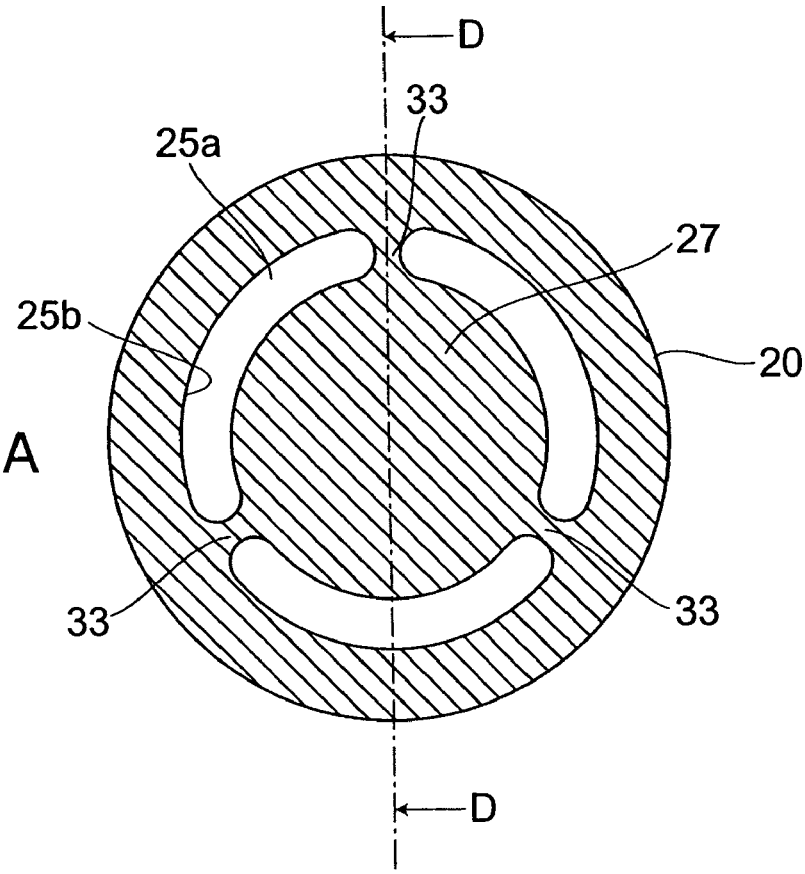
FIG. 7A is a cross-sectional view of the relevant part of the jet nozzle of still another example.
Figure 7B:
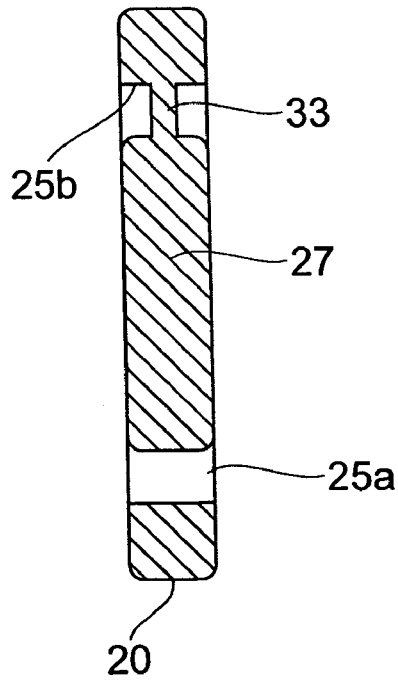
FIG. 7B is a D-D cross-sectional view of FIG. 7A.

As shown in FIG. 7A and FIG. 7B, which is the D-D cross-sectional view thereof, after the tube 20 and the interceptor 27 are integrally formed, the portion around the interceptor 27 can be bored, leaving supports 33, to form channels 25*a* allowing water to flow from the chamber 25 to the ejection port 26.

Next, the operation of the jetted bathtub according to the embodiment of the invention is described with reference to FIG. 2.

When a bather manipulates the switch of a controller, not shown, disposed near the bathtub 1, the pump 7 is activated, and water stored in the bathtub 1 is sucked from the suction port 5 to the circulation path 13. The sucked water is pressurized by the pump 7 and introduced through the circulation path 14 to the running water introduction port 21 of the jet nozzle 11. The pressurized water introduced into the jet nozzle 11 is ejected into the bathtub 1 as a swirling jet flow with irregularly varied ejection direction.

FIGS. 8A to 8D are schematic views for illustrating the operation in which a swirling jet flow is produced in the jet nozzle 11.

The pressurized water introduced from the running water introduction port 21 sequentially passes through the running water introduction section 22, the channel cross-section shrinking section 23, and the channel cross-section abrupt expansion section 24, and flows into the chamber 25 as a jet flow. When the pressurized water flows into the chamber 25 from the channel cross-section shrinking section 23, the abrupt expansion of the channel cross section hinders the water from flowing along the inner wall surface of the tube 20, that is, causes flow separation from the inner wall surface of the channel.

In general, a jet flow exchanges momentum with an external fluid, which is thereby accelerated and entangled in the jet flow. At this time, if a wall surface exists near the jet flow, the jet flow itself is bent toward the wall surface by the reaction of the attractive force that serves to attract the external fluid inside, and the flow travels along the wall surface again. That is, the flow is reattached to a portion of the circumference of the inner wall surface of the chamber 25.

The main flow attached to the inner wall surface of the chamber 25 continues to travel along the inner wall surface of the chamber 25, flows between the outer peripheral surface of the interceptor 27 and the inner wall surface of the chamber 25 toward the ejection port 26, and is ejected from the ejection port 26 into the bathtub 1 as a jet flow inclined with respect to the axial center C along the beveled surface 28 beveled toward the axial center of the tube 20 before (upstream of) the ejection port 26.

Thus a main flow (represented by the bold arrow a in FIG. 8A) is produced in the jet nozzle 11.

The channel cross section of the ejection port 26 is larger than that of the channel cross-section shrinking section 23, and the flow is decelerated toward downstream. That is, an adverse pressure gradient, in which the static pressure increases toward downstream, occurs inside the chamber 25. Furthermore, the interceptor 27 is disposed in the chamber 25 so as to partly intercept the channel. For these reasons, part of the above main flow is not ejected from the ejection port 26, but is returned to the upstream side of the chamber 25 as shown by the arrow b in FIG. 8B.

Figure 8A:
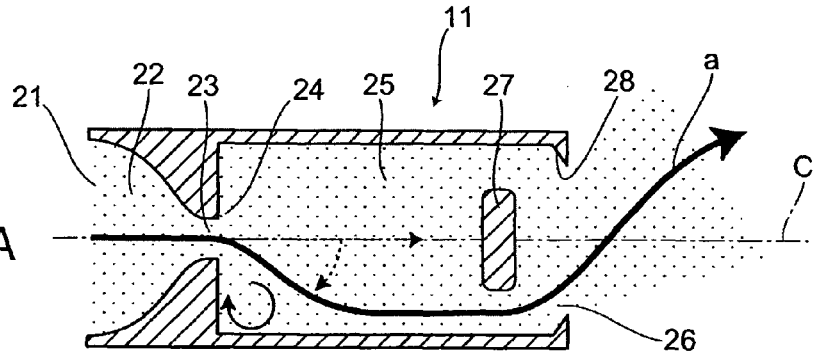
FIGS. 8A to 8D are schematic views for illustrating the operation in which a swirling jet flow is produced in the jet nozzle according to this embodiment.
Figure 8B:
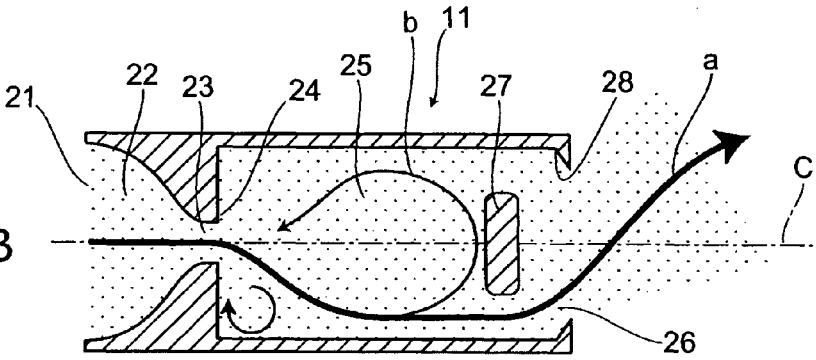
Figure 8C:
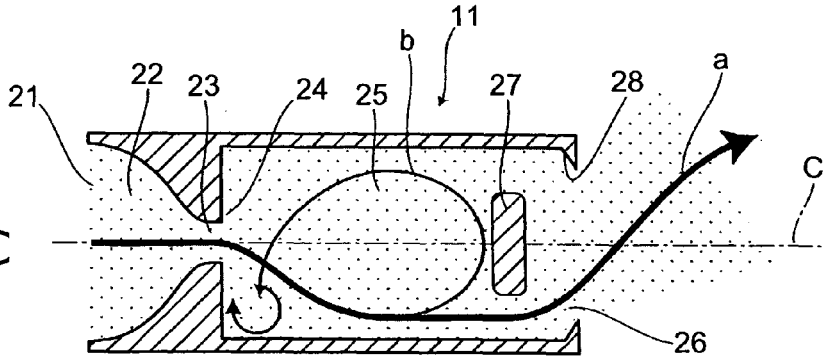
Figure 8D:
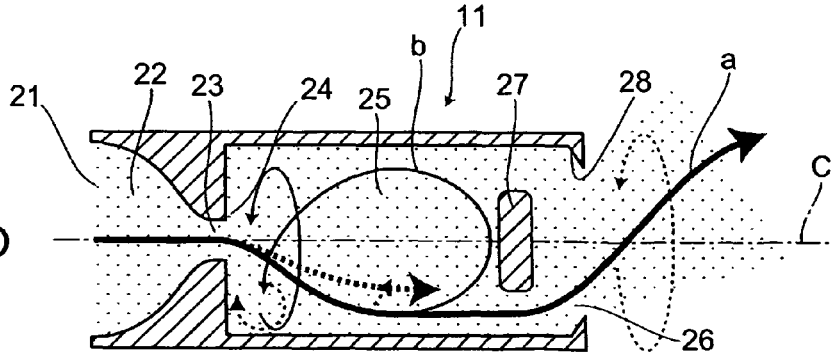
Figure 9A:
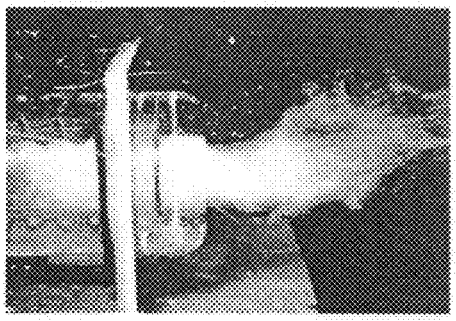
FIGS. 9A to 9D are photographs showing a swirling jet flow ejected from the jet nozzle according to this embodiment, where the ejected flow is visualized by bubbles mixed therein.
Figure 9B:
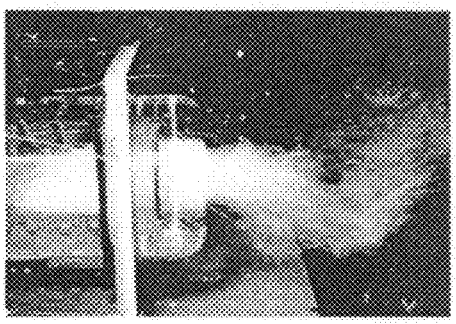
Figure 9C:
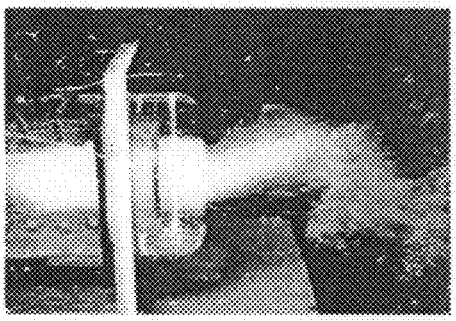
Figure 9D:
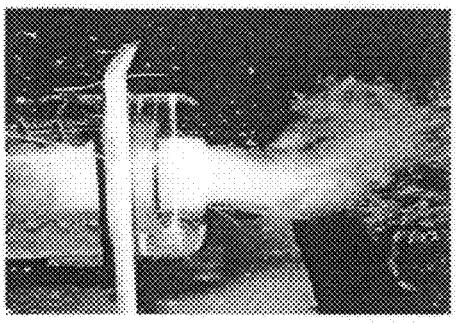

As shown in FIG. 8C, the flow returned to the upstream side flows into the stagnation region where the main flow is separated near the channel cross-section abrupt expansion section 24. As shown in FIG. 8D, this produces a swirling flow about the central axis C near the channel cross-section abrupt expansion section 24. Thus the reattachment position of the main flow on the inner wall surface is irregularly varied in the circumferential direction, and a jet flow irregularly swirling about the central axis C is ejected from the ejection port 26.

FIGS. 9A to 9D are photographs showing a swirling jet flow ejected from the jet nozzle 11 according to this embodiment, where the ejected flow is visualized by bubbles mixed therein. As described above, the pressure is lower in the chamber 25 than at the plane of the ejection port 26. If the nozzle 11 is attached at a height as shown in FIG. 3, negative pressure generally occurs in the chamber 25. Thus, air can be automatically supplied by providing an air inflow port at an arbitrary position of the chamber wall.

The bather can enjoy a massage effect by receiving the swirling jet flow ejected from the jet nozzle 11 at a portion of the body such as the hip, back, shoulder, hand, and foot. The jet flow ejected from the jet nozzle 11 is a broad, soft swirling jet flow, which is different from the narrow, strong, and linear jet flow produced by commonly-known bubble baths. Hence the present jet flow can wrap around the hip and entirely press and massage the back and hip, achieving a massage feeling close to extensive massage by hands, rather than local, strong feeling of stimulation. Thus the bather can feel relaxed in the bath for a long time without boredom. Furthermore, in the case of locally receiving a linear strong jet flow, the bather tends to be strained to keep the posture for receiving the jet flow at a desired spot. However, the swirling jet flow of this embodiment provides an extensive and soft stimulus, and hence does not force the bather to be strained, but tends to allow the bather to be relaxed.

The jet flow ejected from the jet nozzle 11 according to this embodiment is swirling. Hence it achieves a sufficient feeling of stimulation for massage feeling without bubbles mixed therein. On the contrary, this embodiment can provide a massage feeling close to manual massage, like being pressed by water, which cannot be achieved by bubble mixing. Furthermore, because bubbles are not mixed, the ejection noise of the jet flow and the noise during bubble mixing can be reduced, allowing relaxation in a quiet environment. Naturally, bubbles can be easily mixed as described above, and hence can be mixed into the swirling jet flow according to this embodiment. In this case, the swirling force of the jet flow is weakened as compared with the case of no bubble mixing.

The inventors conducted a sensory test in nine subjects for jet flows with and without bubble mixing. The result is listed in TABLES 1 and 2.

TABLE 1

| | Which jet flow is felt stronger? | | |
|---|---|---|---|
| | Without bubbles | No difference | With bubbles |
| Subject 1 | | ○ | |
| Subject 2 | | ○ | |
| Subject 3 | | | ○ |
| Subject 4 | | ○ | |
| Subject 5 | | | ○ |
| Subject 6 | | | ○ |
| Subject 7 | | ○ | |
| Subject 8 | | | ○ |
| Subject 9 | | | ○ |
| Total | 0 | 4 | 5 |

(L = 76.6 [mm], D = 27.3 [mm], d = 8.3 [mm], Q = 40 [L/min])

TABLE 2

| | Which jet flow is swirling more clearly? | | |
|---|---|---|---|
| | Without bubbles | No difference | With bubbles |
| Subject 1 | ○ | | |
| Subject 2 | | ○ | |
| Subject 3 | ○ | | |
| Subject 4 | ○ | | |
| Subject 5 | ○ | | |
| Subject 6 | ○ | | |
| Subject 7 | ○ | | |
| Subject 8 | | | ○ |
| Subject 9 | | | ○ |
| Total | 6 | 1 | 2 |

(L = 76.6 [mm], D = 27.3 [mm], d = 8.3 [mm], Q = 40 [L/min])

From the result of TABLE 1, the stimulus tends to be felt stronger for the bubble-mixed jet flow. From the result of TABLE 2, swirling is felt more clearly for the jet flow without bubble mixing. Hence, various feelings of stimulation can be realized by switching on and off the bubble mixing or adjusting the amount of bubble mixing in response to the user's preference.

For example, if the amount of bubble mixing is large, the overall flow rate of the jet flow increases, and a strong stimulus can be realized. If the amount of bubble mixing is small, a large number of bubbles as small as approximately several mm in diameter can be generated, and a soft feeling of stimulation, enveloped in small bubbles, can be realized. Furthermore, mixing fine bubbles of several ten μm realizes a jet flow made whitish by bubbles, which is visually enjoyable.

The jet nozzle 11 according to this embodiment is configured so that the fluid introduced into the jet nozzle 11 excites by itself the swirling of the jet flow ejected from the ejection port 26 by the back-flow action in the chamber 25 as described above. Thus the rotary sliding portion as disclosed in JP-A 2001-8998(Kokai) is not needed. Hence the nozzle structure is simplified, can be fabricated at low cost, and facilitates maintenance. Furthermore, there is no concern about the decrease of swirling performance due to wear and clogging in the rotary sliding portion.

Furthermore, as described above, the nozzle of JP-A 2001-8998(Kokai) has a doubly nested structure. This complicates the structure, and includes a narrow gap between the nozzle body corresponding to an inner tube and the attachment member corresponding to an outer tube. Thus, there is also concern about clogging of the gap with dust. Likewise, the nozzle of JP-A 2-128765(Kokai) and JP-A 4-61859(Kokai) also has a double structure. Hence the structure is complicated, and there is concern about clogging of the narrow channel (gap).

In contrast, this embodiment does not include another channel formed as a narrow gap outside the central channel as in JP-A 2001-8998(Kokai), JP-A 2-128765(Kokai), and JP-A 4-61859(Kokai), but the tube 20 has a single structure. More specifically, in a single space (channel) surrounded by one tube 20, a main flow directed to the ejection port 26 is produced in combination with a back flow running counter to the main flow, and is ejected as a swirling jet flow into the water. Hence the structure is simplified, can be fabricated at low cost, and facilitates maintenance. Furthermore, there is no concern about the decrease of swirling performance due to clogging.

As described above, in this embodiment, the static pressure in the chamber 25 is lower than the static pressure of water Stored in the bathtub 1, and an adverse pressure gradient, in which the static pressure increases toward downstream, occurs inside the chamber 25. Hence, the back flow, derived from part of the main flow returned to the upstream side of the chamber 25, can be produced without the interceptor 27. However, the interceptor 27 serves to produce a stable (more reliable) back flow as compared with the back flow formation by the adverse pressure gradient (static pressure increasing in the flow direction), and hence stabilizes the swirling of the jet flow.

As described above, the main flow is deflected to a portion of the circumference of the inner wall of the chamber 25, and hence a deflected jet flow is realized without the beveled surface 28 before (upstream of) the ejection port 26. However, by providing the beveled surface 28 and causing the main flow to follow the beveled surface 28, the deflection of the main flow can be enhanced, which facilitates producing a soft swirling jet flow more extensively.

Figure 10:
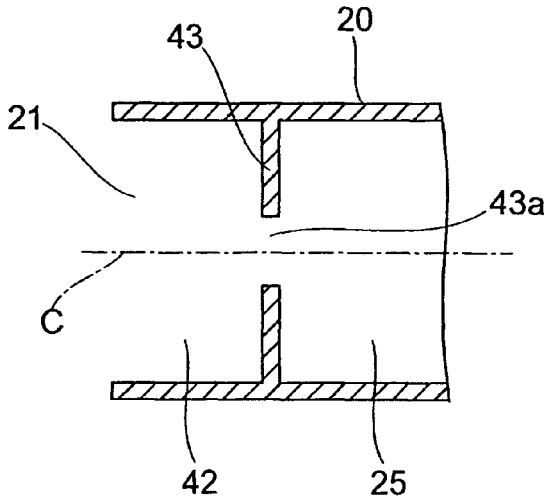
FIG. 10 is a cross-sectional view of the relevant part of the jet nozzle according to another example.

As shown in FIG. 10, the inner diameter of the running water introduction section 42 can be generally constant in the region from the running water introduction port 21 to the channel cross-section shrinking section 43*a*. In this case, a diaphragm 43 generally perpendicular to the axial center C is disposed at the boundary between the running water introduction section 42 and the chamber 25, and a hole is provided at the center of the diaphragm 43. Thus the channel cross-section shrinking section 43*a* is configured as an orifice.

However, as in the above embodiment shown in FIG. 1, if the channel cross section of the running water introduction section 22 is gradually narrowed from the running water introduction port 21 to the channel cross-section shrinking section 23, the pressure loss in the jet nozzle 11 decreases, eliminating the need to apply high pressure for ejection. That is, a large pump 7 is not needed, allowing reduction of installation space and cost.

Figure 11:
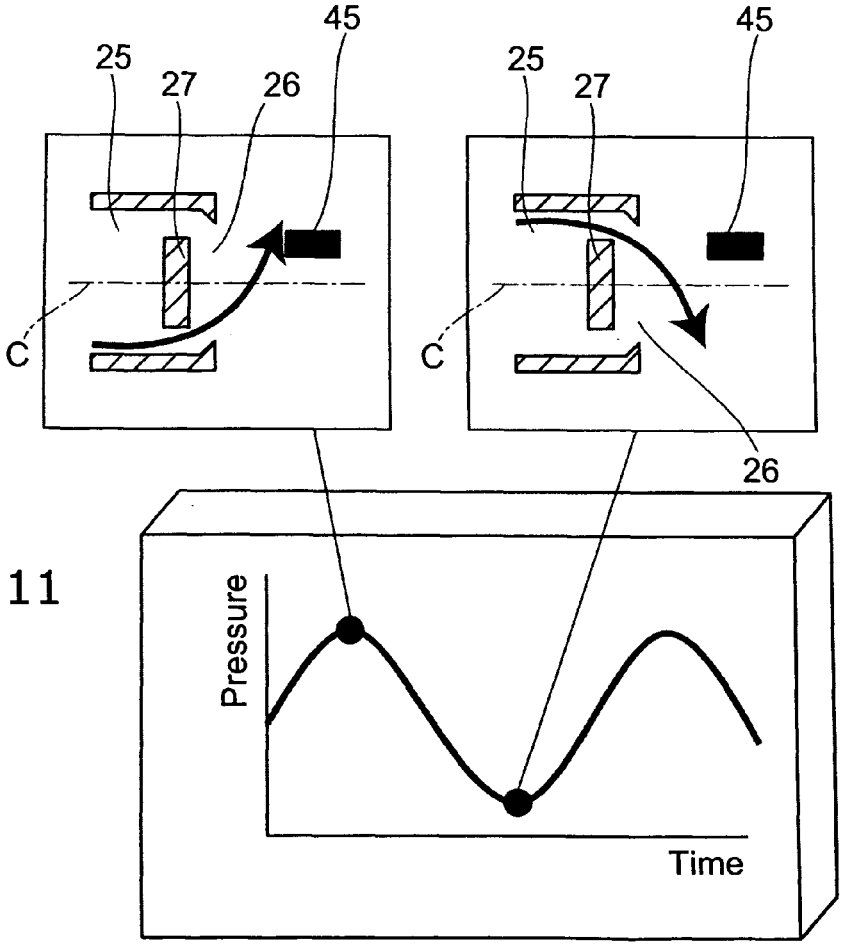
FIG. 11 is a schematic view for illustrating a measurement experiment of the pressure of the swirling jet flow ejected from the ejection port by a manometer placed near the ejection port of the jet nozzle according to this embodiment.

As shown in FIG. 11, the inventors measured the pressure of the swirling jet flow ejected from the ejection port 26 by a manometer 45 placed near the ejection port 26. The manometer 45 was placed at a position 30 mm distant from the ejection port 26 and 10 mm above the axial center C.

The dimensions d, D, $D_{CB}$, h, $D_{out}$, L, and X of the jet nozzle 11 shown in FIG. 1 were designed as follows: The inner diameter of the channel cross-section shrinking section 23, d=8.3 mm; the inner diameter of the channel cross-section abrupt expansion section 24 and the chamber 25, D=27.8 mm; the outer diameter of the interceptor 27, $D_{CB}$=20.9 mm; the axial thickness of the interceptor 27, h=5.8 mm; the diameter of the ejection port 26, $D_{out}$=22.3 mm; the length of the chamber 25, L=76.6 mm; the distance from the axial center of the interceptor 27 to the ejection port 26, X=10.4 mm.

When the jet flow passes through the measurement point, the measured pressure exhibits a larger value because the dynamic pressure of the jet flow is added. More specifically, a waveform synchronized with the passage of the jet flow is obtained as shown in the graph of FIG. 11, where the horizontal axis represents time, and the vertical axis represents the measurement value of the manometer 45. The frequency of temporal variation in this waveform coincides with the frequency of the passage of the jet flow. Hence, fast Fourier transform (FFT) is applied to the temporal variation data of the swirling jet flow pressure measured by the manometer 45 to calculate the swirling frequency spectrum of the swirling jet flow pressure.

Figure 12:
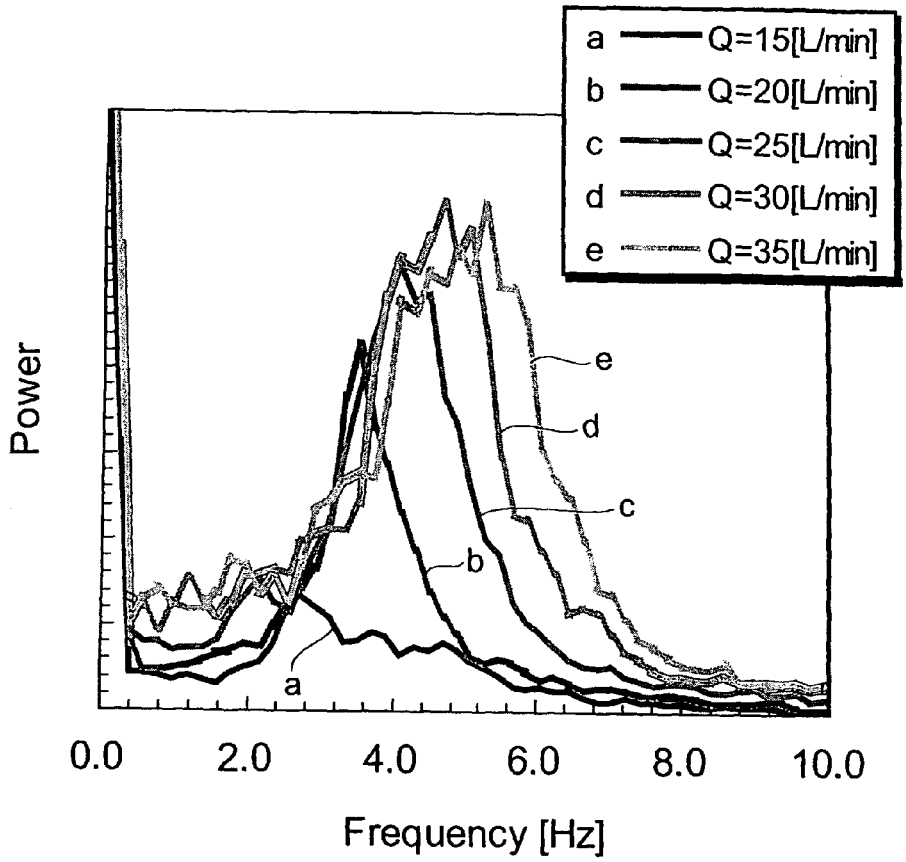
FIG. 12 is graphs of the calculated swirling spectrum of the swirling jet flow pressure by applying fast Fourier transform (FFT) to the temporal variation data of the swirling jet flow pressure measured by the manometer shown in FIG. 11.

FIG. 12 shows the calculated graphs, where a, b, c, d, and e represent the graphs for the flow rate of the ejected flow being set to 15, 20, 25, 30, and 35 liters/min, respectively.

From the result of FIG. 12, the swirling frequency of the ejected flow is approximately 1 to 6 Hz, which provides a bather with a stimulus close to manual massage. Furthermore, the swirling frequency is not constant, but varies irregularly. This provides a natural massage feeling, and is unlikely to strain the bather.

Figure 13:
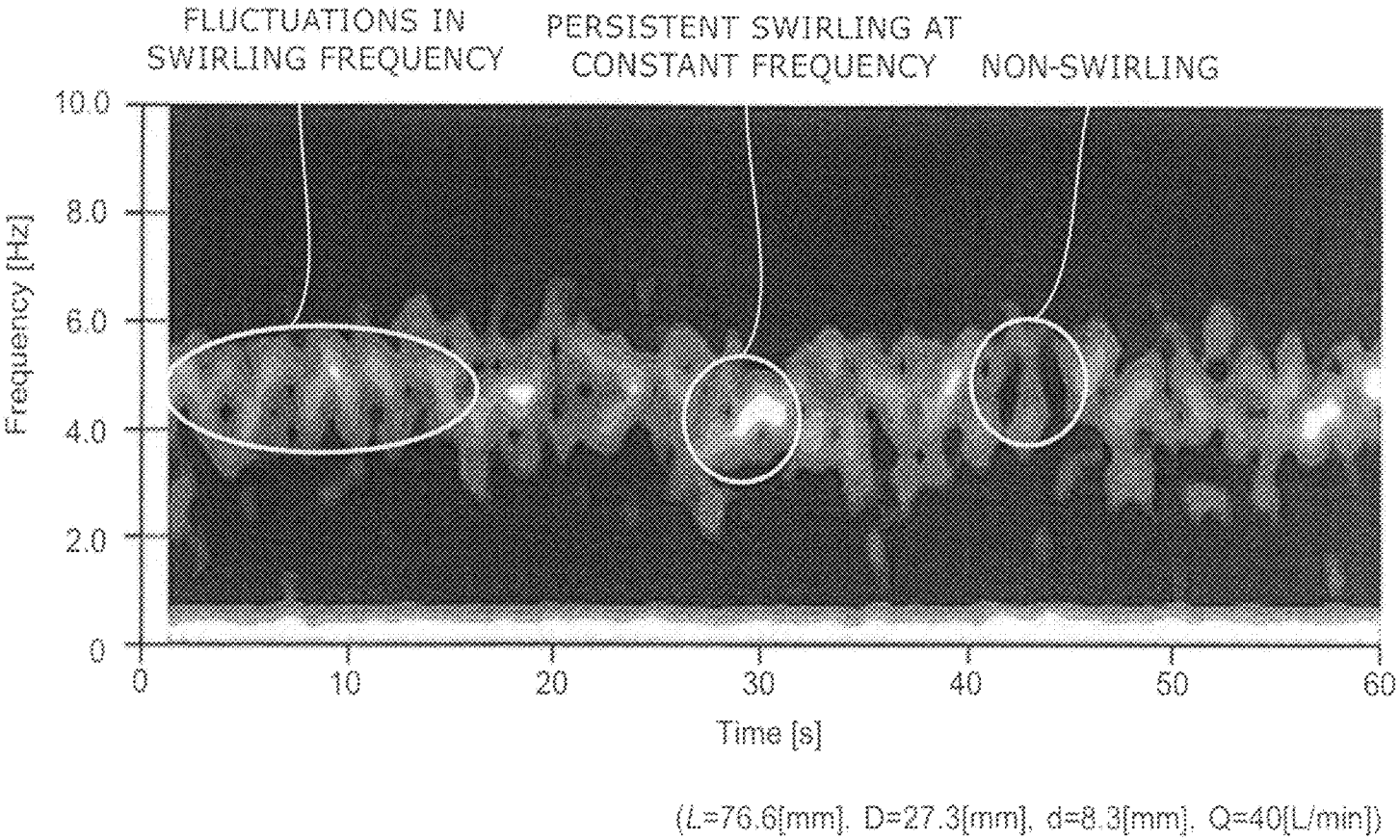
FIG. 13 shows the temporal variation in the swirling frequency of the jet flow obtained from the temporal variation of the pressure measured by the manometer shown in FIG. 11.

FIG. 13 shows the temporal variation in the swirling frequency of the jet flow obtained by applying fast Fourier transform to sequences of data, each corresponding to a regular time slot in the temporal variation of the pressure measured by the manometer 45. In FIG. 13, the vertical axis represents frequency, the horizontal axis represents time, and the shading represents the magnitude of power of the frequency spectrum, where lighter shading represents higher power.

In this embodiment, the disturbance in the working fluid itself produces the swirling motion of the jet flow. Hence, as shown in FIG. 13, time periods with irregular fluctuations in the swirling frequency, time periods with swirling at nearly constant frequency, and time periods without swirling occur irregularly. Consequently, a swirling jet flow with natural fluctuations can be realized without special control. This can provide a feeling close to manual massage, achieving diversified stimuli without boredom.

The configuration of JP-A 2001-8998(Kokai) provides a constant swirling frequency, which is boring and cannot provide various massage feelings.

Upon receiving stimuli on the skin in the range of ten and several Hz to several hundred Hz, receptors in human skin for feeling stimuli produce an illusion of continuously receiving stimuli or receiving nearly continuous stimuli, although the receptors depend on individuals and spots subjected to the stimuli. Hence, to provide swirling-induced feelings of stimulation, it is preferable that the swirling frequency be approximately 1 to 6 Hz.

Figure 14:
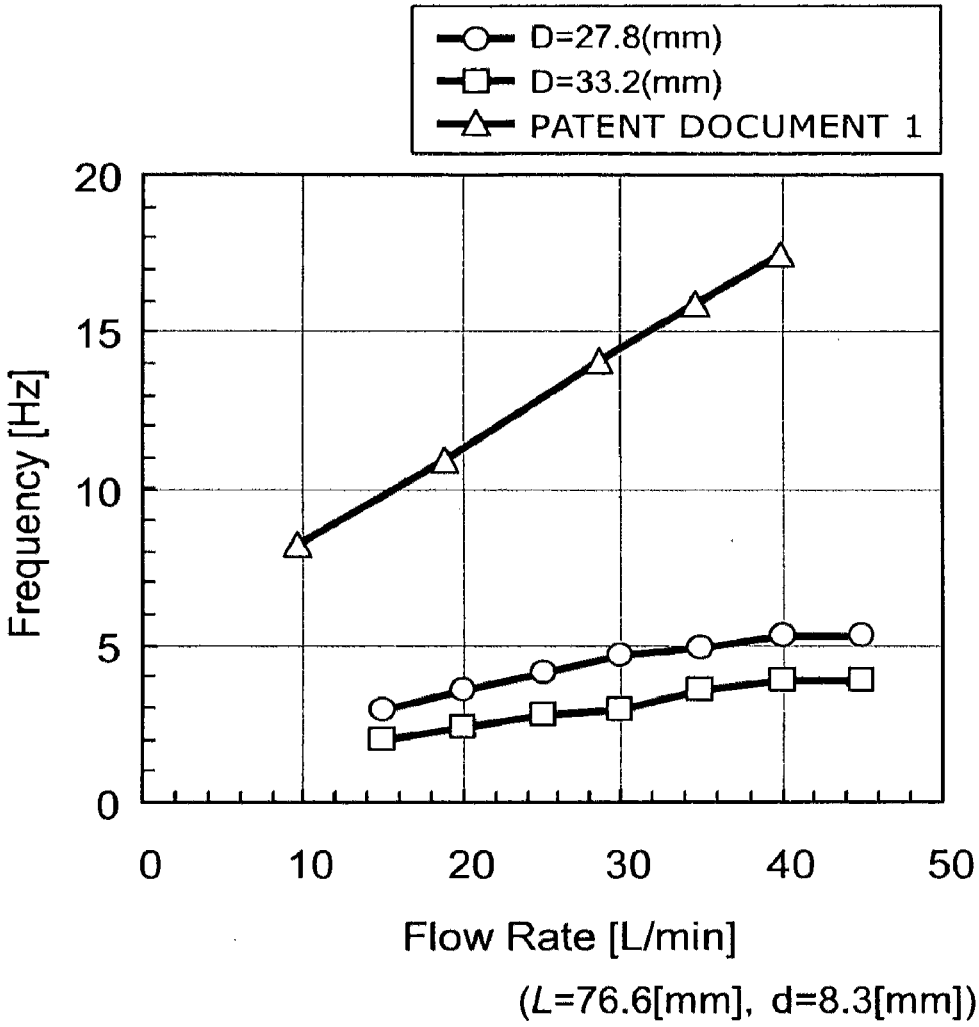
FIG. 14 is a graph showing the relationship between the flow rate and the swirling frequency of the ejected flow.

FIG. 14 is a graph showing the relationship between flow rate and swirling frequency. The horizontal axis represents the flow rate (liters/min) measured by a flowmeter disposed in the circulation path 14 connected downstream of the pump 7, and the vertical axis represents the time-averaged swirling frequency (Hz) of the jet flow. In the graph, the circle represents the case where the chamber 25 has an inner diameter D=27.8 mm in the configuration of this embodiment, and the square represents the case of D=33.2 mm, whereas the triangle represents the configuration of JP-A 2001-8998(Kokai).

In the configuration of JP-A 2001-8998(Kokai), the flow rate is in proportion to the swirling frequency. A slower swirling frequency requires a lower flow rate, which decreases the feeling of stimulation. Conversely, a higher flow rate for enhancing the feeling of stimulation results in a higher swirling frequency.

In this embodiment, the variation of swirling frequency with respect to the variation of flow rate is smaller than in JP-A 2001-8998(Kokai). The swirling frequency is nearly constant at a flow rate of 40 liters/min or more. Furthermore, the swirling frequency is almost determined by the nozzle shape (chamber diameter D), and does not greatly depend on the flow rate. Hence the flow rate can be varied, that is, the feeling of stimulation can be adjusted, while maintaining a desired swirling frequency to achieve the feeling of manual massage.

Figure 15:
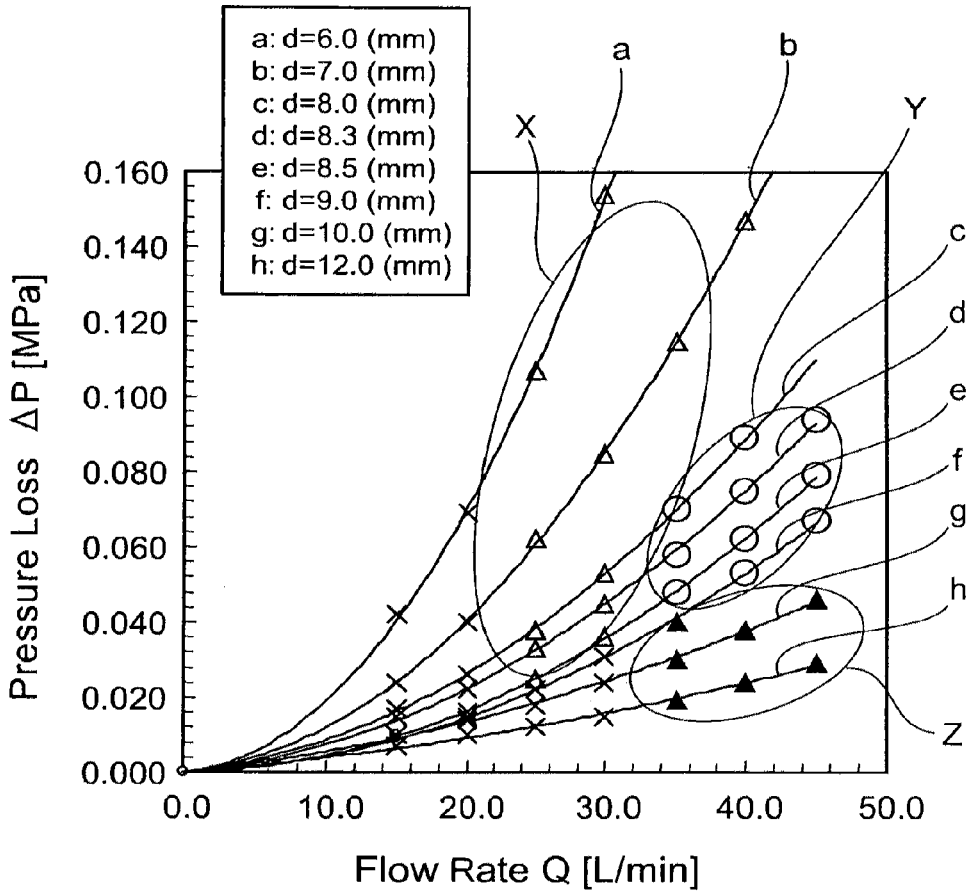
FIG. 15 is graphs showing the result of measuring the flow rate and pressure with the inner diameter d of the channel cross-section shrinking section in the jet nozzle according to this embodiment being varied.

FIG. 15 shows the result of measuring the flow rate (liters/min) and pressure (MPa) with the inner diameter d of the channel cross-section shrinking section (the diameter of the inflow path to the chamber 25) being varied. The flow rate was measured by a flowmeter disposed in the circulation path 14 connected downstream of the pump 7, and the pressure was measured by a manometer disposed in the circulation path 14 downstream of the flowmeter and before (upstream of) the jet nozzle 11.

In FIG. 15, *a, b, c, d, e, f, g*, and *h* represent the graphs for the inner diameter d of the channel cross-section shrinking section being set to 6.0, 7.0, 8.0, 8.3, 8.5, 9.0, 10.0, and 12.0 mm, respectively. The dimensions of the other portions D, $D_{CB}$, h, $D_{out}$, L, and X are the same as described above.

The curves in FIG. 15 are labeled with symbols indicating the result of sensory evaluation for the feeling of swirling (the degree of feeling the swirling of the jet flow) and the feeling of stimulation (the degree of the stimulus strength of the jet flow). The cross mark (x), hollow triangle (Δ), solid triangle (▲), and hollow circle (○) represent the case where both the feeling of swirling and the feeling of stimulation are insufficient, the case where the feeling of swirling is sufficient but the feeling of stimulation is insufficient, the case where the feeling of swirling is insufficient but the feeling of stimulation is sufficient, and the case where both the feeling of swirling and the feeling of stimulation are sufficient, respectively.

From the result of FIG. 15, for a larger inner diameter d of the channel cross-section shrinking section, the pressure in the circulation path 14 before the jet nozzle 11 is smaller, that is, the pressure loss in the nozzle section is smaller. However, if the inner diameter d of the channel cross-section shrinking section is too large, the swirling performance of the ejected flow decreases (region Z in FIG. 15). Hence, to achieve a desired swirling performance while decreasing the pressure loss, it is preferable that the inner diameter d of the channel cross-section shrinking section be approximately 9.0 mm or less.

Even if the inner diameter d of the channel cross-section shrinking section is approximately 9.0 mm or less, a flow rate less than 20 liters/min results in an excessively weak jet flow, and the swirling of the jet flow can be felt only slightly. Furthermore, although the swirling of the jet flow can be felt at a flow rate of 25 liters/min or more, the jet flow is felt narrow if the inner diameter d of the channel cross-section shrinking section is too small, and the feeling of stimulation is not appealing for a jetted bathtub (region X in FIG. 15). For these reasons, to provide both the feeling of swirling and the feeling of stimulation, that is, a feeling close to manual massage, it is preferable that the inner diameter d of the channel cross-section shrinking section be 8.0 to 9.0 mm and the flow rate be 30 liters/min or more (region Y in FIG. 15).

Figure 16:
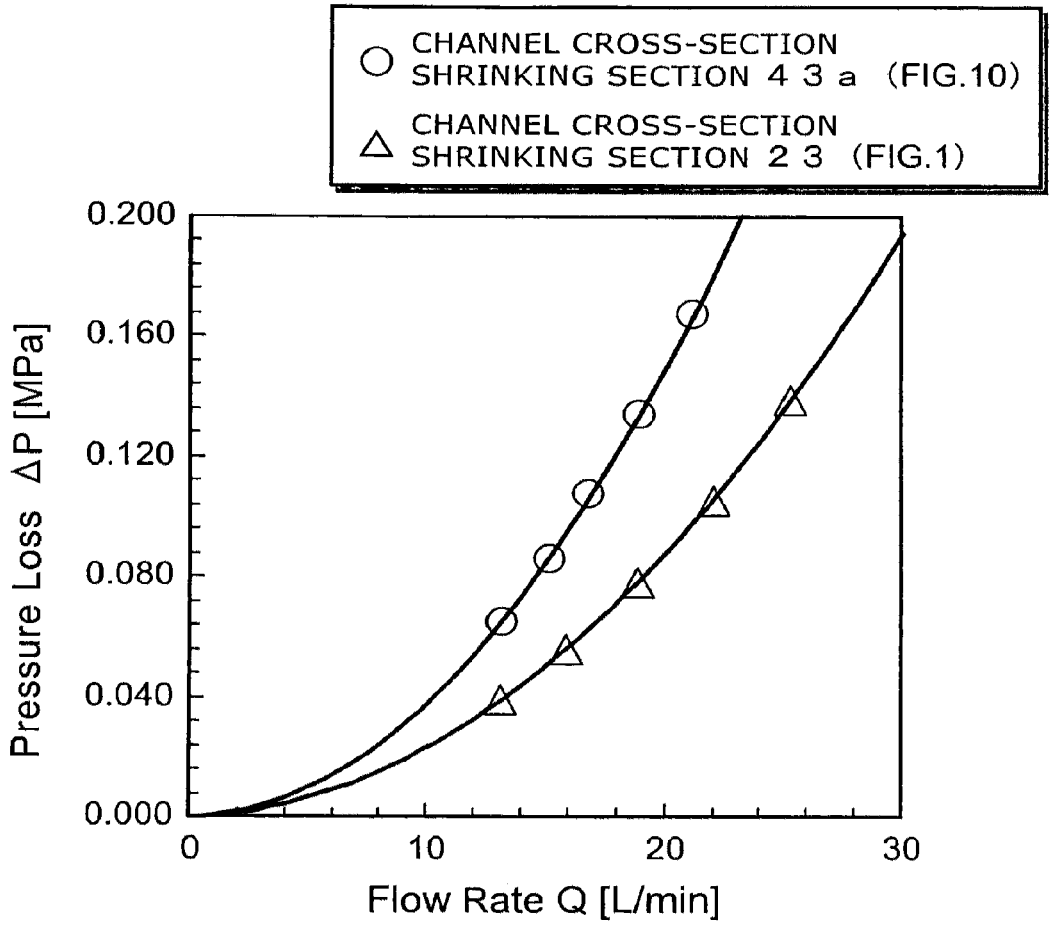
FIG. 16 is a graph showing the difference in the magnitude of pressure loss due to the difference in the shape of the channel cross-section shrinking section.

FIG. 16 shows the difference in the magnitude of pressure loss due to the difference in the shape of the channel cross-section shrinking section.

The measurement of pressure loss was performed by the same method as described above. In the graph, the hollow circle (○) represents the result of using the channel cross-section shrinking section 23 shown in FIG. 1, and the hollow triangle (Δ) represents the result of using the channel cross-section shrinking section 43*a* shown in FIG. 10.

The inner diameter d of the channel cross-section shrinking section is set to 5.5 mm, and the dimensions of the other portions D, $D_{CB}$, h, $D_{out}$, L, and X are the same as described above. In this condition, comparing at the same flow rate in the range of 10 to 50 liters/min, the magnitude of pressure loss in the nozzle section using the channel cross-section shrinking section 23 shown in FIG. 1, in which the channel cross section gradually shrinks toward the flow direction, is approximately 60% of that for the channel cross-section shrinking section 43*a* shown in FIG. 10, in which the cross section sharply shrinks. Thus, to decrease the pressure loss, the shape having a gradually shrinking cross section like the channel cross-section shrinking section 23 shown in FIG. 1 is preferable.

Figure 17:
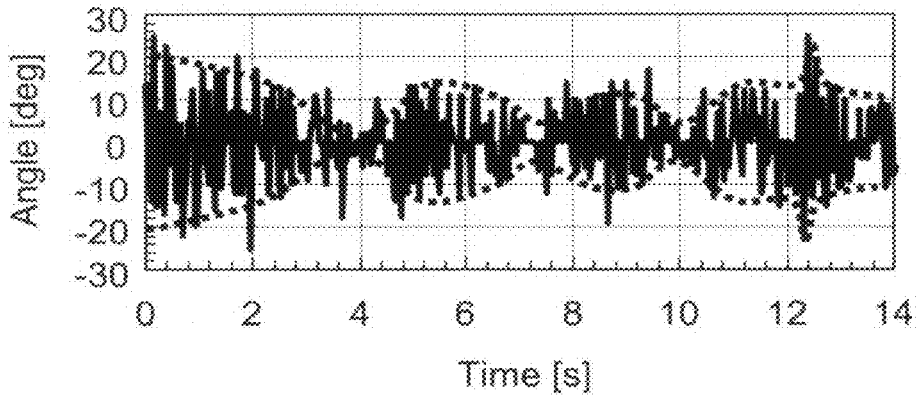
FIG. 17 is a graph showing the temporal variation of the ejection angle of the swirling jet flow, or jet flow angle, in the jet nozzle according to this embodiment.

FIG. 17 is a graph showing the temporal variation of the ejection angle of the swirling jet flow, or jet flow angle, in the jet nozzle 11 according to this embodiment.

Figures 18A, 18B:
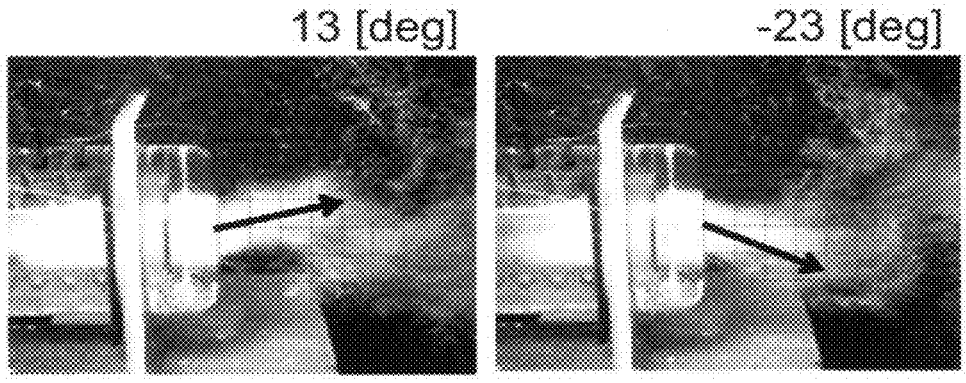
FIGS. 18A and 18B are photographs showing the case of the jet flow angle being 13° and −23°, respectively, in the jet nozzle according to this embodiment.

The jet flow angle is defined as the angle of the swirling jet flow viewed from the side at an instant with respect to the central axis C of the jet nozzle 11. It is defined positive if it is inclined upward with respect to the central axis C (angle 0°), and negative if it is inclined downward. For example, FIGS. 18A and 18B are photographs showing the case of the jet flow angle being 13° and −23°, respectively.

In the case of being actually massaged by a person, while a load is applied to the client's body surface, the load position is moved. Hence the direction of the load on the body surface is generally oblique to the body surface. Like the manual massage, the swirling jet flow of this embodiment is ejected with deflection from the central axis C. Furthermore, the impact point of the jet flow is moved, and the jet flow impinges obliquely on the body surface, which facilitates achieving a feeling close to manual massage.

Moreover, as shown in FIG. 17, the swirling jet flow of this embodiment is ejected at an inclination of 0° to 30° from the central axis C of the jet nozzle 11. Hence the feeling of stimulation depends on the distance from the ejection port 26. In the case where the distance from the ejection port 26 is approximately 20 mm or less, the jet flow provides a feeling of stimulation like being strongly pressed in a narrow area. At a position where the distance from the ejection port 26 is approximately 20 to 100 mm, the swirling of the jet flow is felt significantly, and the jet flow provides a massage feeling. At a position where the distance from the ejection port 26 is approximately 100 mm or more, the jet flow broadly diffused by swirling provides a feeling of stimulation like being pressed extensively.

As seen from the result of FIG. 17, the ejection angle fluctuates irregularly over time. Thus, a swirling jet flow rich in variety can be realized without special control. Irregular variation in the ejection angle of the swirling jet flow produces irregular variation in the impact area of the swirling jet flow, and does not cause boredom.

As shown in FIG. 3, when a bather is relaxed in the bath with the back leaned on the short sidewall 4*a*, the bather takes a bathing posture in which the buttocks are positioned slightly distant from the short sidewall 4*a* with the head placed on a bathtub pillow, not shown, or the neck, the shoulder, or part of the back being in contact with the short sidewall 4*a*. Hence the bather's upper body is automatically inclined with respect to the short sidewall 4*a*. At the height where the jet nozzle 11 is installed (230 mm from the bottom in this embodiment), a gap of approximately 30 to 100 mm occurs between the short sidewall 4*a* and the bather. On the other hand, the jet nozzle 11 is composed of at least two nozzle components detachable from each other and is held on a hole opening in the short sidewall 4*a* so that the plurality of nozzle components sandwich the short sidewall 4*a* using connection means such as flanges. Hence the tip of the jet nozzle 11, that is, the ejection port 26, is located at approximately 5 to 10 mm from the short sidewall 4*a* into the bathtub.

That is, by disposing the jet nozzle 11 on the short sidewall 4*a*, the distance from the ejection port 26 to the bather's body is approximately 20 to 95 mm. Thus the jet flow can accurately impinge on a portion of the body of the bather whose back is leaned on the short sidewall 4*a*, achieving a sufficient feeling of manual massage.

As described above, the jet flow ejected from the jet nozzle 11 is a swirling jet flow providing a soft stimulus, particularly in the case of no bubble mixing. Hence, as compared with the case of the jet flow providing a linear strong stimulus, the bather tends to come close to the ejection port 26, and may occlude the ejection port 26 with the back in some cases.

Thus the tip of the jet nozzle 11 is projected by e.g. 10 mm into the bathtub from the inner surface of the short sidewall 4*a* on which the jet nozzle 11 is installed. Then, even if the bather closely puts the back on the inner surface of the short sidewall 4*a*, the projection of the jet nozzle 11 interferes with the back and discomforts the bather. Hence the bather automatically takes a posture of separating the back from the short sidewall 4*a*. This can prevent the bather's back from occluding the ejection port 26.

If the projected length of the tip of the jet nozzle 11 from the wall inner surface is 5 mm or less, it is difficult for a bather to feel the projection of the jet nozzle 11. If the projected length is 30 mm or more, the projected portion is a nuisance during bathing, and also compromises the design. Hence the projected length of the tip of the jet nozzle 11 from the wall inner surface is preferably set in the range of 5 to 30 mm.

Consider a configuration of the bathtub with its height from the bathtub bottom to the rim surface being 525 mm. The jet nozzle 11 is disposed on the short sidewall so that its tip is projected 10 mm into the bathtub. If a bather being 155 to 175 cm tall gets in (sits on the bottom of) the bathtub with the portion from the head to the neck leaned on the rim and the upper back being in contact with the wall surface, the distance from the tip of the jet nozzle 11 to the bather's back or hip is 30 to 80 mm. This allows the above swirling jet flow from the jet nozzle 11 to accurately impinge on a portion of the bather's back or hip, providing a sufficient feeling of manual massage or acupressure.

In the swirling jet flow ejected from the jet nozzle 11, the area in which the jet flow impinges on the bather's body (impact area) depends more greatly on the distance between the ejection port and the bather's body than in the linearly ejected jet flow. Hence, the bather may fail to receive the feeling of manual massage or acupressure depending on the distance to the ejection port. However, as described above, by appropriately setting the projected length of the tip of the jet nozzle 11, the distance between the ejection port and the bather's body can be automatically caused to be 30 to 80 mm, achieving a sufficient feeling of manual massage or acupressure.

Figure 29:
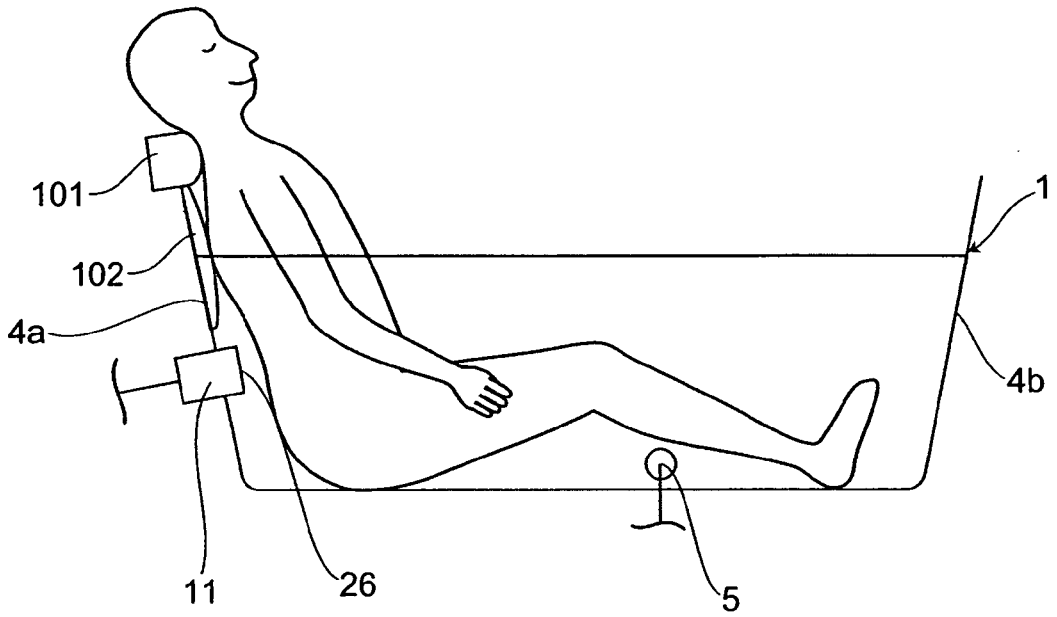
FIG. 29 shows a variation having a mechanism leading a bather's posture in the jetted bathtub according to this embodiment of the invention.

Furthermore, as shown in FIG. 29, a pillow 101 and a backrest 102 projected into the bathtub can also be disposed on the upper portion of the short sidewall 4*a* to which the jet nozzle 11 is attached (on the portion above the installation position of the jet nozzle 11) to lead the bather to a desired posture so that a desired spacing (30 to 80 mm) automatically occurs between the ejection port 26 and the bather's back or hip.

Assume that the thickness of the pillow 101 and the backrest 102 is set to [the projected length of the jet nozzle 11] + [30 to 80 mm]. Then, if a bather sits on the bathtub bottom in a posture with the portion from the head to the neck leaned on the pillow 101 and the backrest 102, the bather's back or hip is automatically separated 30 to 80 mm from the tip of the jet nozzle 11, and an optimal posture for receiving a feeling of manual massage or acupressure can be realized. It is noted that it is also possible to provide only one of the pillow 101 and the backrest 102.

The gap between the interceptor 27 and the inner wall surface of the chamber 25 is preferably 5 mm or less to prevent insertion of a child's finger. The inner periphery of the ejection port 26 is preferably formed into a curved configuration, rather than an edged configuration, to ensure safety even if a finger is hooked thereon.

The height of the jet nozzle 11 from the bathtub bottom can be suitably set in the range where the jet flow ejected from the jet nozzle 11 does not shoot out of the surface of water stored in the bathtub 1.

Figure 25:
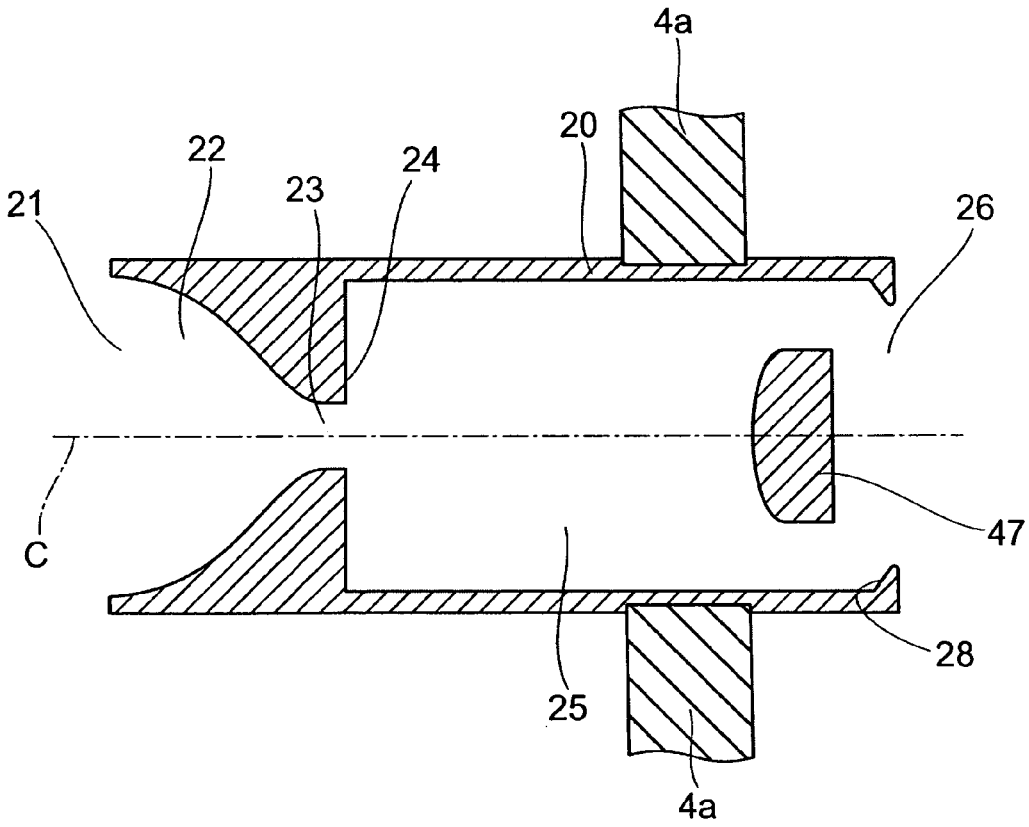
FIG. 25 is a schematic cross-sectional view of a jet nozzle according to another example.

FIG. 25 shows another example of the jet nozzle. In the interceptor 47 of this jet nozzle, the surface on the opposite side (upstream side) of the surface facing the ejection port 26 is formed into a curved configuration. By using a curved configuration for the surface on which the water flowing in the chamber 25 impinges, the impact of sand and other foreign particles contained in the water on the interceptor 47 can be alleviated, and the interceptor 47 can be prevented from disengagement and damage.

The number of suction ports 5 is not limited to one, but a plurality of suction ports 5 can be provided.

It is noted that sand and the like may enter the bathtub. If the flow rate in the circulation path 13, 14 is too high, sand and the like may hit and damage the inner wall surface of the pipe. Hence the inner diameter of the circulation path is preferably designed so that the flow rate in the circulation path 13, 14 is approximately 2 m/sec or less.

Although not shown, the pump 7 can be integrally provided on the running water introduction port 21 side of the jet nozzle 11.

Figure 19:
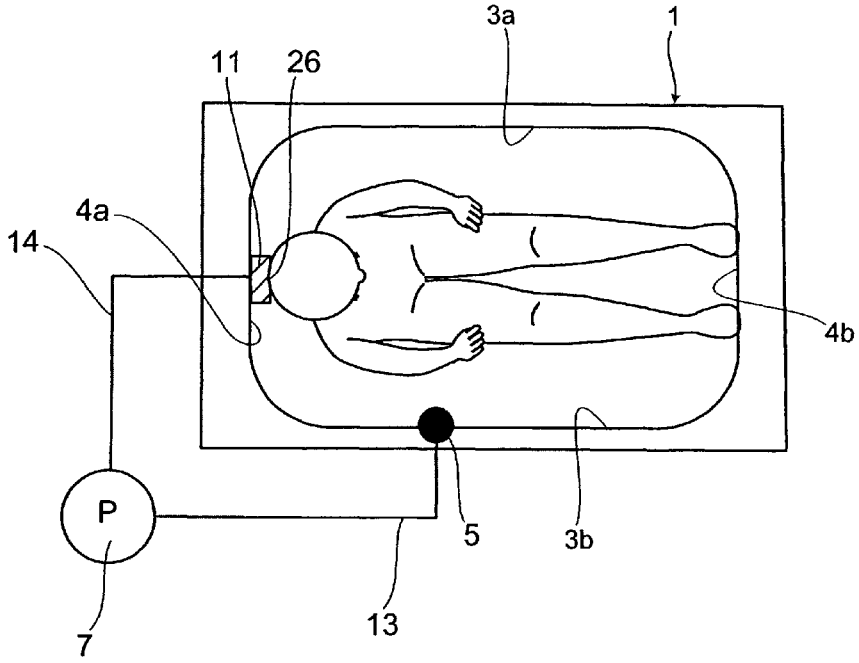
FIG. 19 is a schematic view showing the schematic configuration of a jetted bathtub according to another example.

The number of jet nozzles 11 is not limited to two, but a single jet nozzle 11 can be disposed on the short sidewall 4*a* as shown in FIG. 19. Naturally, three or more jet nozzles 11 can be disposed.

Figure 20:
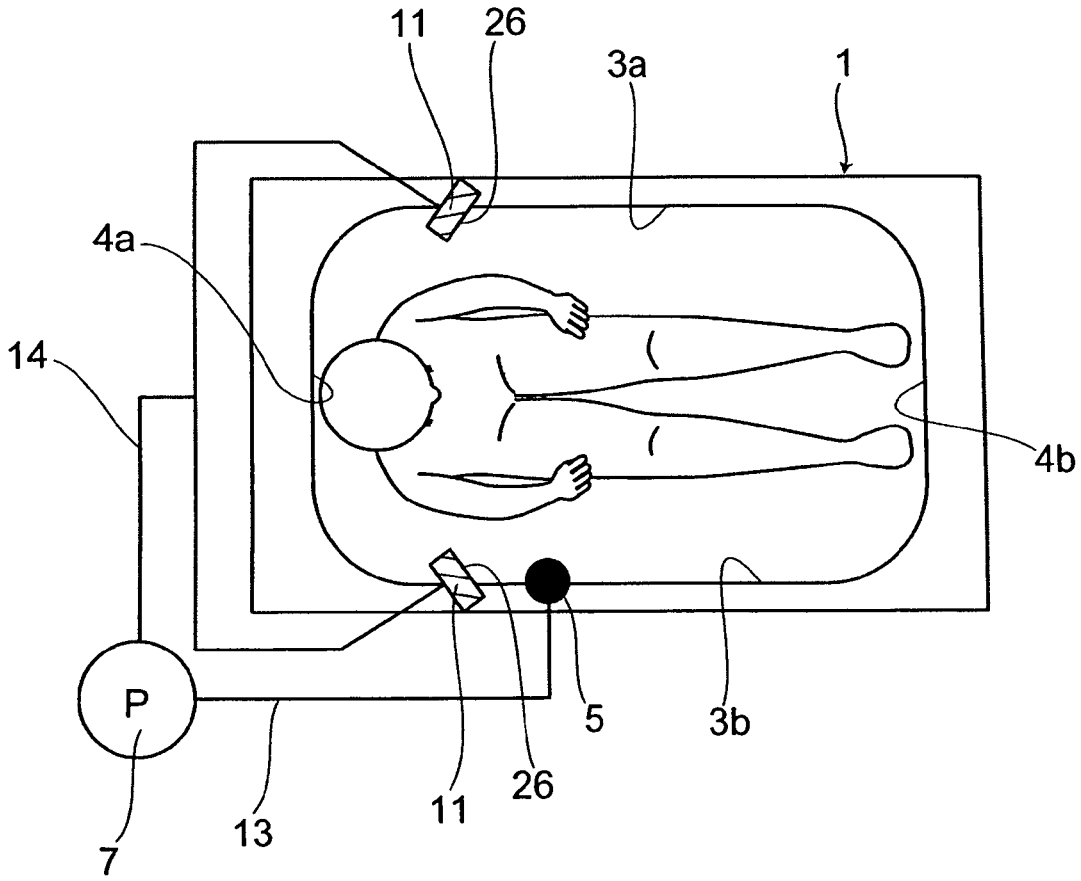
FIG. 20 is a schematic view showing the schematic configuration of a jetted bathtub according to still another example.
Figure 21:
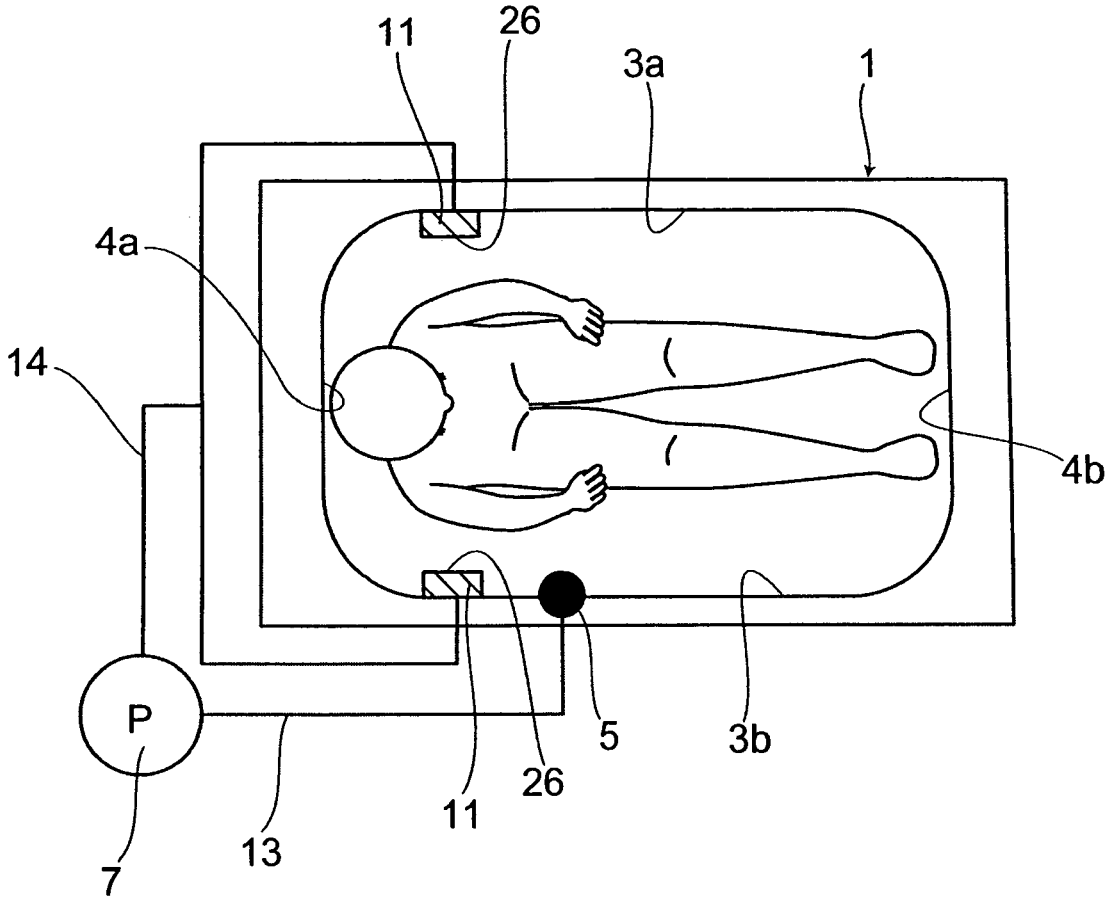
FIG. 21 is a schematic view showing the schematic configuration of a jetted bathtub according to still another example.

Furthermore, as shown in FIGS. 20 and 21, the jet nozzle 11 can be disposed on each of the pair of long sidewalls 3*a*, 3*b* at a position close to the short sidewall 4*a* (the position located beside the waist of the bather with the back facing the short sidewall 4*a*). In the case of FIG. 20, a swirling jet flow is ejected from the ejection port 26 of each jet nozzle 11 toward the bather's flank and leg. In the case of FIG. 21, each ejection port 26 is directed to the long sidewall 3*a*, 3*b* opposed to the long sidewall 3*a*, 3*b* on which it is disposed. A swirling jet flow is ejected from each ejection port 26 toward the bather's lateral side in a direction generally perpendicular to the long side of the bathtub 1.

Figure 22:
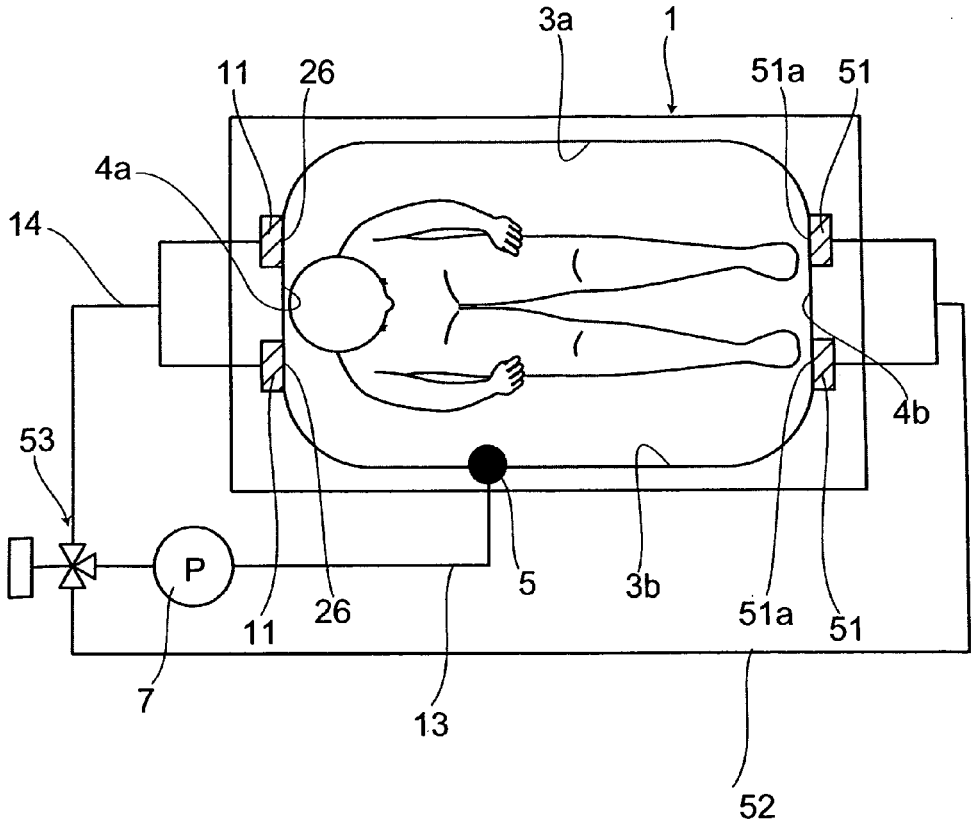
FIG. 22 is a schematic view showing the schematic configuration of a jetted bathtub according to still another example.

Furthermore, as shown in FIG. 22, two jet nozzles 51, illustratively spaced from each other along the short side of the bathtub, can be disposed on the short sidewall 4*b* facing the bather's feet. The jet nozzle 51 can be a nozzle for ejecting a swirling jet flow like the jet nozzle 11 described above, or a nozzle for ejecting a straight jet flow. Furthermore, the jet nozzle 51 can be a bubble jet nozzle for ejecting a jet flow mixed with bubbles. The ejection port 51*a* of each jet nozzle 51 faces the short sidewall 4*a* on the opposite side. A jet flow is ejected from each ejection port Sla toward the bather's sole, leg, and the front of the body.

The suction port of the pump 7 is connected through the circulation path 13 to the suction port 5, which illustratively opens in the long sidewall 3*b*. The discharge port of the pump 7 is connected through a switching means (e.g., three-way valve) 53 to the circulation path 14 and a circulation path 52. The circulation path 14 is connected to the jet nozzle 11 disposed on one short sidewall 4*a*, and the circulation path 52 is connected to the jet nozzle 51 disposed on the other short sidewall 4*b*.

The switching means 53 selectively switches the destination of the pressurized water discharged from the pump 7 to the circulation path 14 or the circulation path 52. This switching control can be an open/close control for connecting only one of the circulation paths 14, 52 to the pump 7, or a variable flow rate ratio control for both the circulation paths 14, 52, where both the circulation paths 14, 52 are connected to the pump 7.

Figure 23:
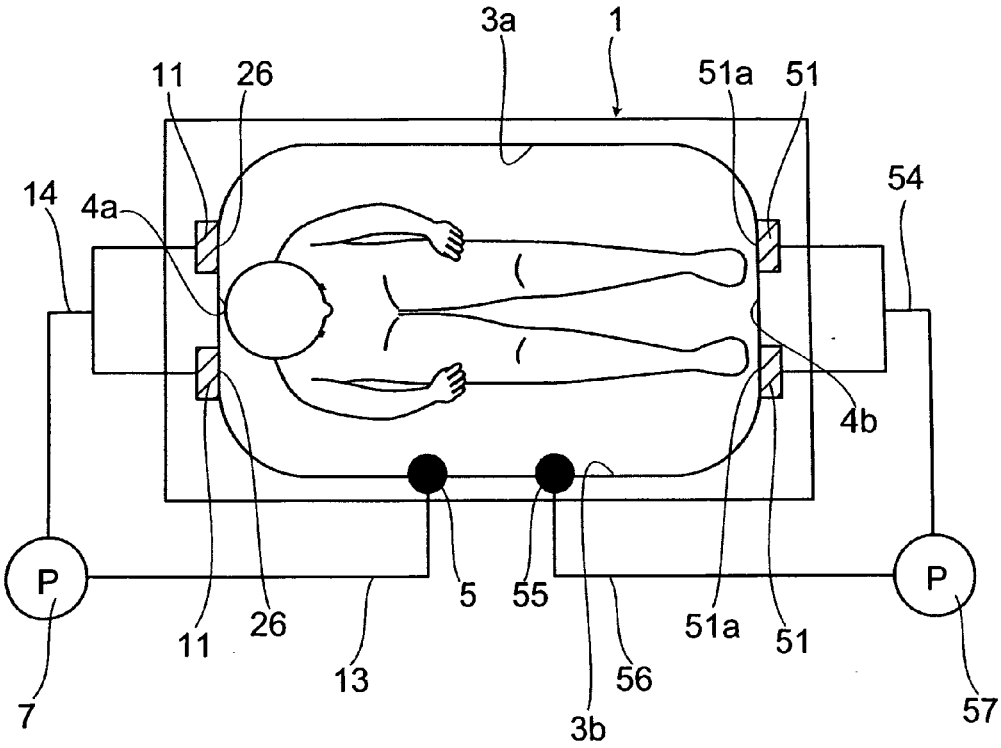
FIG. 23 is a schematic view showing the schematic configuration of a jetted bathtub according to still another example.

In the case where a plurality of jet nozzles 11, 51 are disposed, a plurality of lines can be installed for the water supply paths (circulation paths) to the jet nozzles 11, 51 as shown in FIG. 23.

For example, two suction ports 5, 55 are formed in the long sidewalls 3*b*. One suction port 5 is connected through a circulation path 13, a pump 7, and a circulation path 14 to the jet nozzle 11 disposed on the first short sidewall 4*a*. The other suction port 55 is connected through a circulation path 56, a pump 57, and a circulation path 54 to the jet nozzle 51 disposed on the second short sidewall 4*b*.

Figure 24:
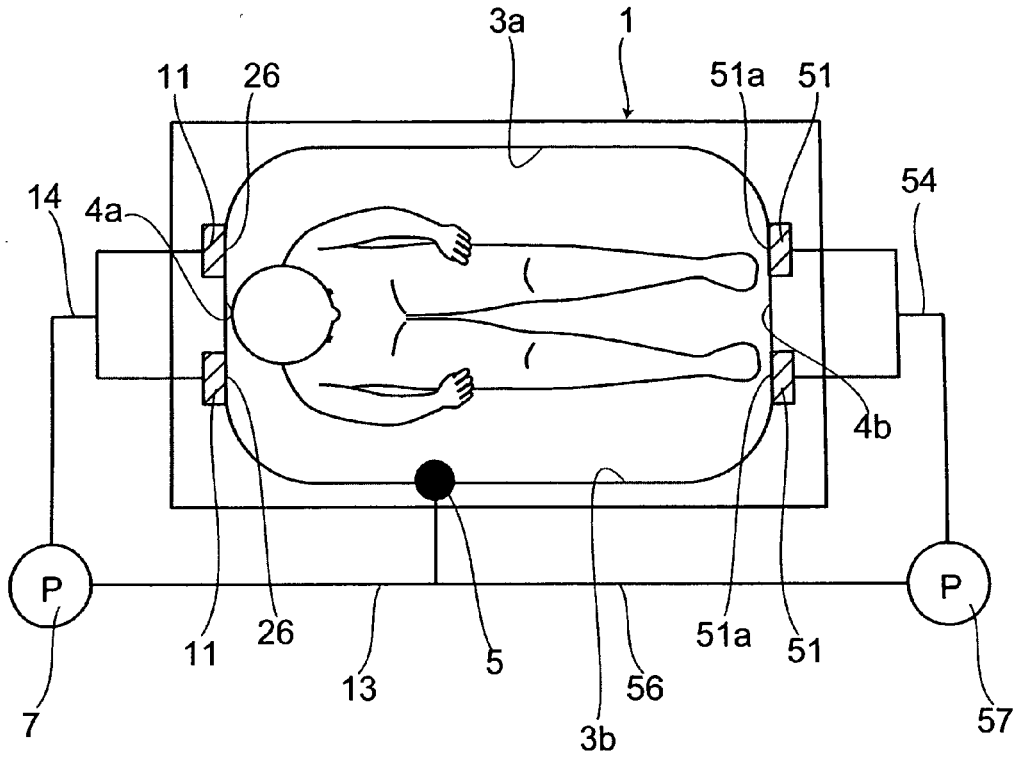
FIG. 24 is a schematic view showing the schematic configuration of a jetted bathtub according to still another example.

Even in the case where two circulation lines and pumps are installed, the lines can also share a single suction port 5 as shown in FIG. 24.

Figure 28:
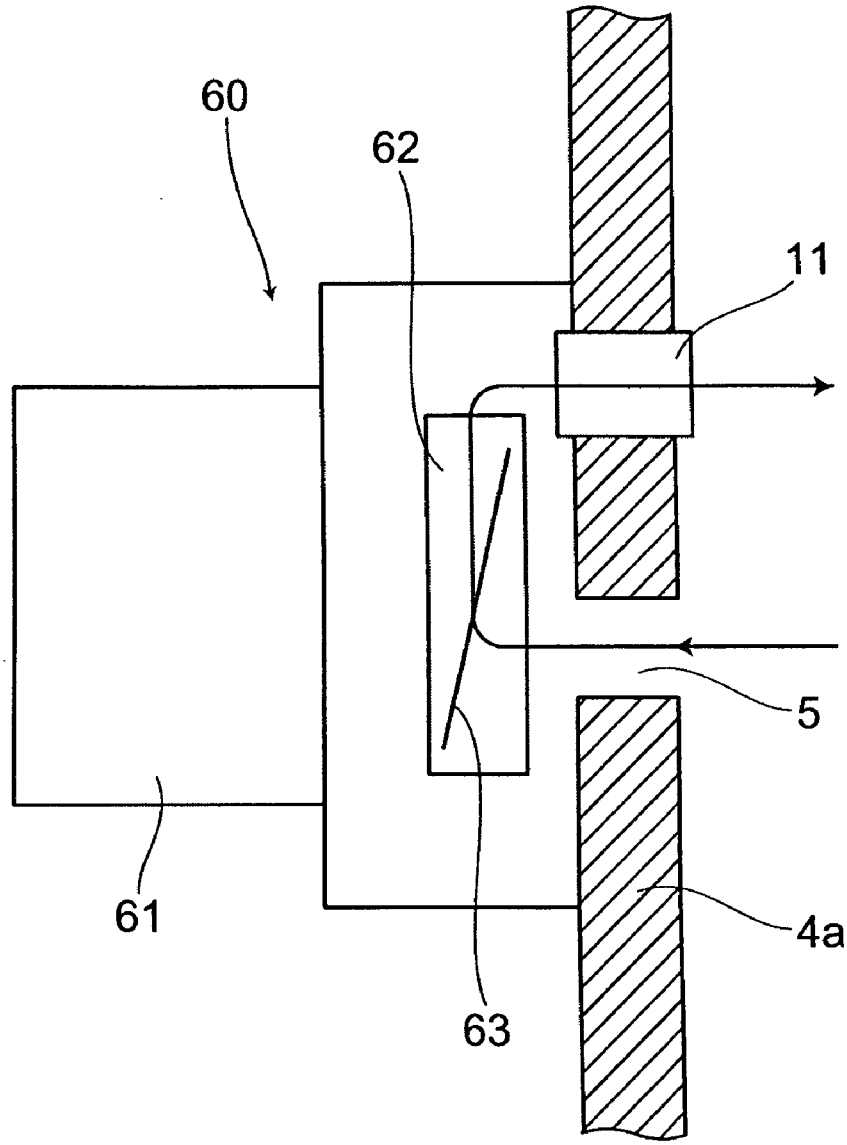
FIG. 28 shows another example of the attached configuration of a pump in the jetted bathtub according to this embodiment of the invention.

Furthermore, as shown in FIG. 28, a pump 60 can be disposed on the outer wall surface of the wall 4*a* to which the jet nozzle 11 is attached.

A suction port 5 is formed in the wall 4*a*. The pump 60 includes a pump chamber 62 in communication with the suction port 5 and the running water introduction port of the jet nozzle 11 through a suction channel and a discharge channel. The pump chamber 62 includes an impeller 63 rotated by a pump motor 61. When the impeller 63 is rotated by the pump motor 61, water in the bathtub is sucked through the suction port 5 and the suction channel into the pump chamber 62, introduced through the discharge channel into the jet nozzle 11, and ejected into the bathtub.

Figure 27:
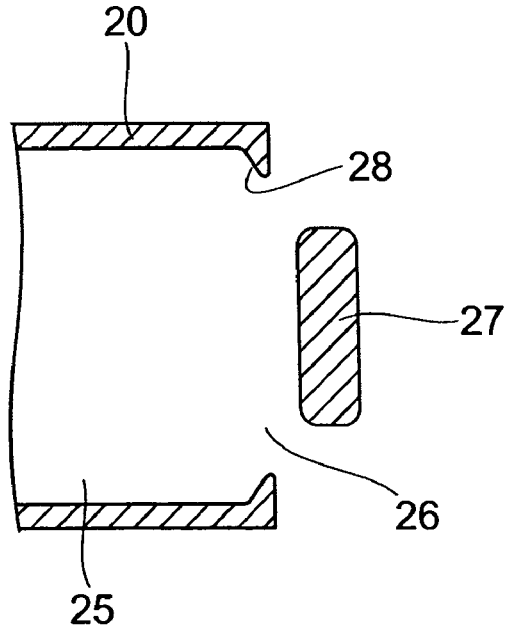
FIG. 27 is a schematic view showing a variation of a disposed position of the interceptor in the jet nozzle according to this embodiment of the invention.

Furthermore, as shown in FIG. 27, the interceptor 27 can be disposed at a position facing the ejection port 26 outside the chamber 25. Also in this case, part of the main flow can be returned to the upstream side of the chamber 25 to produce a swirling jet flow by the action as described above.

The tube 20 is not limited to a generally cylindrical configuration as described in the above embodiment, but can be in a generally elliptic cylindrical configuration.

The invention claimed is:

1. A jetted bathtub comprising:

a bathtub;

a suction port opening in a wall of the bathtub and allowing water stored in the bathtub to be sucked therein;

a pressurizer configured to suck water from the suction port, and pressurize and discharge the water; and a jet nozzle having a single tube held on the wall below a rim of the bathtub, the jet nozzle being configured to eject water introduced into the tube so that the water is ejected into the bathtub with its ejection direction being varied, the tube including:

a running water introduction section configured to receive water supplied from the pressurizer;

a channel cross-section shrinking section communicating with the running water introduction section on the downstream side of the running water introduction section, and having a reduced channel cross section relative to the running water introduction section;

a chamber communicating with the channel cross-section shrinking section on the downstream side of the channel cross-section shrinking section, the chamber having at its upstream end a channel cross-section abrupt expansion section with a channel cross section abruptly expanded relative to the channel cross-section shrinking section, having at its downstream end an ejection port facing the inside of the bathtub, and having an inner wall continuing to the ejection port on the downstream side and beveled inwardly toward an axial center of the tube; and an interceptor disposed near the ejection port in the chamber and configured to partly intercept a channel communicating with the ejection port.

2. The jetted bathtub according to claim 1, wherein the tube is held on a first short sidewall of the bathtub, and the ejection port faces a second short sidewall.

3. The jetted bathtub according to claim 1, wherein the running water introduction section has a channel cross section gradually narrowed toward the channel cross-section shrinking section.

4. The jetted bathtub according to claim 1, wherein the interceptor is supported on an inner wall of the chamber through three or more supports radially disposed between the interceptor and the inner wall of the chamber.

5. The jetted bathtub according to claim 4, wherein the interceptor, the supports, and the inner wall of the chamber are integrally formed.

6. The jetted bathtub according to claim 1, wherein all components of the jet nozzle are non-moving when water is being ejected from the jet nozzle.

7. The jetted bathtub according to claim 1, wherein the channel cross-section shrinking section opens directly into the channel cross-section abrupt expansion section.

8. The jetted bathtub according to claim 1, wherein the interceptor is disposed longitudinally inwardly of the chamber relative to the ejection port and produces a stable back flow of water in the chamber.

* * * * *